United States Patent [19]

Vidal

[11] Patent Number: 4,490,862

[45] **Date of Patent: * Jan. 1, 1985**

[54] ATTACHABLE DRAIN FILTER WITH SURFACE IRREGULARITIES TO ENTANGLE HAIR AND DEBRIS

[76] Inventor: Stella M. Vidal, 175 SW. 14th St., Apt. 3, Miami, Fla. 33130

[ * ] Notice: The portion of the term of this patent subsequent to Dec. 6, 2000 has been disclaimed.

[21] Appl. No.: 296,292

[22] Filed: Aug. 26, 1981

[51] Int. Cl.[3] ..... E03C 1/26

[52] U.S. Cl. ..... 4/292

[58] Field of Search ..... 4/286-295; 210/496, 499

[56] References Cited

U.S. PATENT DOCUMENTS

| | | | |
|---|---|---|---|
| 1,224,603 | 5/1917 | Clark | 4/287 |
| 2,447,178 | 8/1948 | Hatchette | 210/499 X |
| 2,464,579 | 5/1949 | Hovanian | 4/287 |
| 3,018,845 | 1/1962 | Powers | 210/499 X |
| 3,959,831 | 6/1976 | Hendricks | 4/287 |
| 3,972,078 | 8/1976 | Maki | 4/287 |
| 4,160,293 | 7/1979 | Niemann | 4/295 X |
| 4,169,059 | 9/1979 | Storms | 210/496 X |

*Primary Examiner*—Charles E. Phillips

*Attorney, Agent, or Firm*—Cooper, Dunham, Clark, Griffin & Moran

[57] ABSTRACT

A drain filter for preventing hair and debris from entering a drain of a bathtub, shower stall, lavatory, sink and the like having a liftable stopper and a flange, the article comprising a body with openings for the passage of water, shaped and dimensioned to extend completely around the external periphery of the drain, covering the area between the periphery and the top of the stopper. This body has filamentary material defining openings, the material having a plurality of outward projections above the openings to entangle hair and debris.

17 Claims, 39 Drawing Figures

FIG. 23
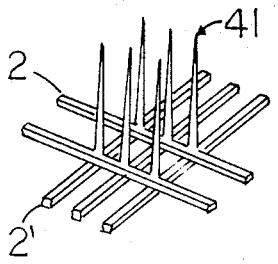
FIG. 24
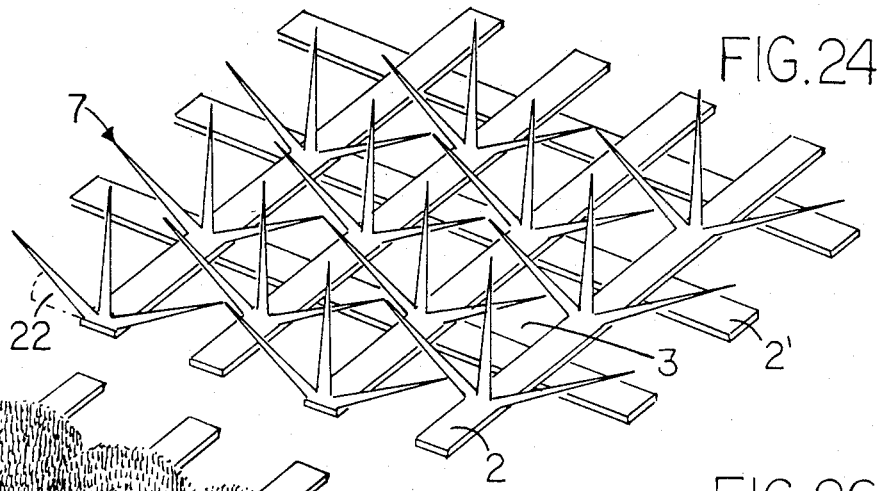
FIG. 25
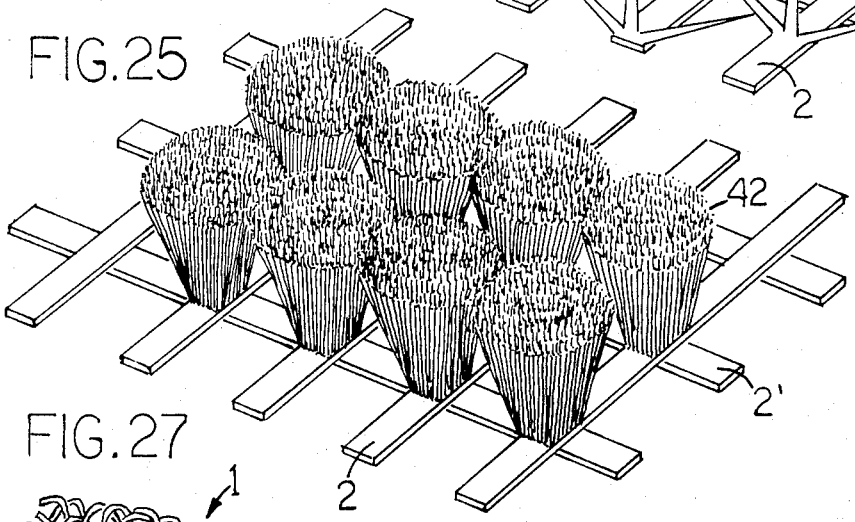
FIG. 26
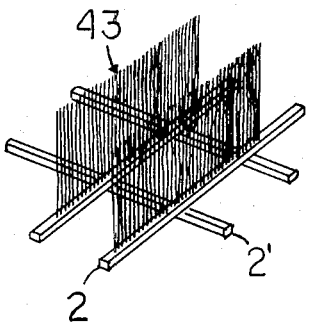
FIG. 27
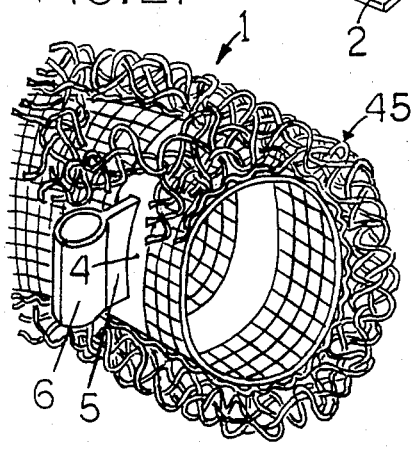
FIG. 28
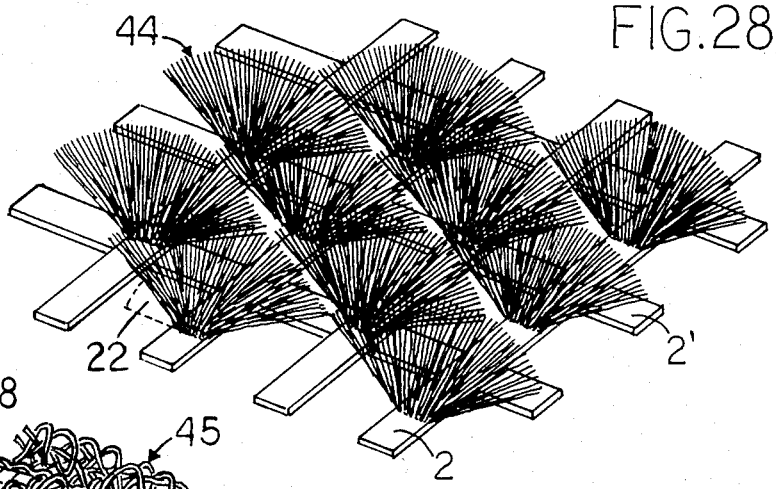
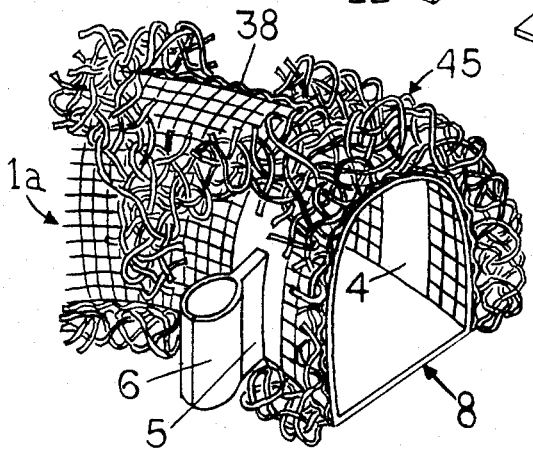
FIG. 29

ATTACHABLE DRAIN FILTER WITH SURFACE IRREGULARITIES TO ENTANGLE HAIR AND DEBRIS

BACKGROUND OF THE INVENTION

The present invention relates to devices for the prevention of clogging of drainpipes of bathtubs, lavatories and the like, particularly due to the accumulation of hair therein. More particularly, the present invention relates to a new drain filter which prevents hair, hairpins or any other object carried away with the water flow during the taking of showers or washings or the like from entering and clogging the drainpipes of bathtubs, lavatories and the like, by means of an entangling action carried out by flexible spikes or bristles or by an adherently bonded flexible open lofty integrated web of continuous crinkled filaments or by rough indented openings, provided on the outer face of the drain filter constituted by a net-like structure, in conjunction with a blocking action carried out by the shape of the drain filter which is shaped to be adapted to surround entirely the periphery the lifted conventional vertically extensible drain stopper or the like, of the drain control systems of bathtubs, lavatories and the like, and both said actions being exerted upon the fallen hair, hairpins or any other object carried away with the water flow, thereby preventing said hair, hairpins or any other object from entering and clogging the drainpipes when the drain filter is installed around and attached to any conventional stopper, while the net-like structure that constitutes the body of the drain filter, or the open web allows, through suitably dimensioned openings, the free flow of running water without hair into the drainpipe openings.

The main cause of clogging of drainpies of bathtubs, shower stalls, lavatories and the like is the accumulation of hair therein. The clogging of drainpipes of bathtubs, shower stalls, lavatories and the like, due to the accumulation fo hair therein during the taking of showers or washings or the like, is a problem that has not yet been properly solved by any one of the usual ways of overcoming this problem which consist in using unclogging chemical products, which represent a health hazard in the home, or using a plunger or a drain auger, or a snake, or calling a plumber. The disadvantages of these approaches to the problem are that they do not prevent the clogging itself by eliminating its cause, which is the entrance of hair into said drainpipes, and only attempt to solve it after it has occurred, often even without good results, and thus drainpipes are regularly clogged because of hair accumulation therein. Other disadvantages of the use of these apparent "solutions" are that they represent a nuisance, an additional expense, and can be damaging to the piping system in the long run, and above all, clogging will keep recurring.

Heretofore, a major disadvantage of the existing strainers which claim to end the clogging problem of drainpipes of bathtubs, shower stalls, lavatories and the like, is that they do not actually prevent said fallen hair from entering and clogging the drainpipes because they do not exert a holding action upon the hair which slides into the openings of said strainers, thus entering and clogging the drainpipes during the taking of showers or washings, or the like. In addition, the existing drain covers provided with a screen which claim to prevent hair from clogging the drainpipes with the screen, actually prevent the free flow of draining water into the drainpipes due to the smallness of the openings of the screen, which intend to impede the passge of hair and foreign matter, thereby causing, during the taking of showers or washings, an accumulation of water on the bathtub and shower stall floor that with the addition of hair, dirt and high density suds, makes it all the more difficult for the water to drain, becoming stagnant, which is most uncomfortable when taking a shower and also requires repeated cleanings afterwards. A similar situation is encountered when shampooing one's hair on the lavatory, where there will be normally a substantial accumulation of both high density suds and hair and the small openings of the screen cause the stagnation of water that with the addition of the aforementioned hair and suds makes it all the more difficult for the water to drain, requiring also repeated cleanings afterwards. Furthermore, a disadvantage of the existing conventional vertically extensible drain stopper, hereinafter called pop-up stoppers, or the like, of the drain control systems of bathtubs, lavatories an the like, in reference to this problem, is that they are not designed to prevent clogging due to the accumulation of hair into said drainpipes. Therefore, there is no device which actually ends the clogging problem of drainpipes in a satisfactory way, and this proves the need for new means of solving this problem.

The present invention provides the means to overcome the foregoing problem and to avoid the aforementioned disadvantages of the prior art, offering novel means for preventing hair from clogging the drainpipes of bathtubs, lavatories and the like, consisting of spikes, bristles, open web of crinkled filaments, or rough indented openings of the net-like structure, to exert an entangling and gripping action upon the fallen hair, hairpins or any other object during the taking of showers or washings or the like, thereby allowing the provision of large enough openings of the net-like structure, and/or of the open web, which constitutes the body of the article, in order to insure the free flow of running water without hair into the drainpipe opening.

SUMMARY OF THE INVENTION

According to the present invention there is provided a new drain filter, hereinafter called article, for preventing the clogging of drainpipes of bathtubs, lavatories and the like, particularly due to the accumulation of hair therein, during the taking of showers or washings or the like, preferably made of a suitable flexible and springy plastic material, although it could also be made of flexible and springy rubber or of any other equally suitable material. The article could be produced by injection molding process or by extrusion process or by any other equally suitable process. The body of the article of the present invention is shaped to be adapted to surround the lifted conventional pop-up stoppers, or the push-button drain valve hereinafter called tip toe stopper, or turnstop stopper, or other pop-up stoppers or the like of the drain control system of bathtubs, lavatories and the like, and it may take any of several preferred cross section forms, such as for example a hollow core cylindrical form or a hollow core elongated semicylindrical form which is integral with a flexible flat thin imperforate lower portion or base, providing several preferred undersurfaces, or a vertical strip-like form which is optionally integral with an outwardly directed surrounding open ended flat thin quite flexible imperforate base having a central hole defined therein with a size generally corresponding to that of the drainpipe opening, an the base providing several preferred undersurfaces. The body of the article in anyone of its preferred cross section forms is open ended, attachable and suitably dimensioned to fit around said lifted conventional stoppers, and is constituted by a net-like structure with a plurality of openings which is integral with imperforate zones which extend along a given area in selected regions, and said imperforate zones bearing attachable means which are placed on said imperforate zones on the inner perimeter of the body of the article, facing the rods or holder slots, or the like, of the lifted trip lever pop-up stoppers, or turnstop stoppers, or the like, the attachable means being flexible but having the necessary stiffness to be tightly affixed to said rods or the like, and the imperforate zones also bearing fastening means which are placed on said imperforate zones on the outer perimeter of the open ends of the body of the article, in order to tightly close its open ends and the fastening means being flexible but having the necessary stiffness to provide a secure installation, after the article has been placed around said lifted stoppers or the like, and attached to the rods or the like, with the attachable means. Optionally, in another example, the vertical strip-like form, as well as another preferred stepped strip-like form, are provided with securement means extending longitudinally along their inner perimeter near the upper portion of said strip-like forms, to be affixed to the underside of the top of knob of the lifted standard tip toe stopper, turnstop stopper, pop-up stopper or the like, of bathtubs, lavatories and the like. The stepped strip-like form is optionally provided with the aforementioned outwardly directed surrounding open ended flat thin quite flexible base having a central hole defined therein. Furthermore, the preferred hollow core cylindrical form and the preferred hollow core semicylindrical form are provided, in another example, only with fastening means, i.e. without attachable means, in order to be fastened around the lifted standard trip lever pop-up stoppers, tip toe stoppers or the like, of bathtubs and the like. The outer face of the net-like structure with a plurality of openings and of the imperforate zones, except on the area where the attachable means and fastening means are placed, is provided in several preferred embodiments with felxible spikes or bristles or with an adherently bonded flexible open lofty integrated web of interengaged continuous crinkled large diameter filaments which may be unmodified or modified, such as for example abrasive filaments or foamed filaments for a gripping action over said fallen hair, or at least the outer face of the net-like structure may be provided wih rough indented openings to exert a gripping action upon the fallen hair. All the preferred cross section forms of the article are preferably dimensioned in such a way as to cover with its body, including the height of spikes, bristles or open web, the entire entrance to the drainpipe openings, and to rest over the flange.

The article of the present invention in its most preferred embodiments prevents hair, hairpins or any other object carried away with the water flow during the taking of showers or washings or the like, from entering and clogging the drainpipes of bathtubs, lavatories and the like, through an entangling action carried out by said spikes or bristles or open lofty web of continuous crinkled filaments, or by rough indented openings of the net-like structure, in conjuntion with a blocking action carried out by the shape of the article, in all its preferred cross section forms, that surround entirely the lifted conventional pop-up stopper or the like of the drain control systems of bathtubs, lavatories and the like, and the entire surrounding area of the drainpipe opening, and both said actions being exerted upon the fallen hair, hairpins or any other object carried away with the water flow when the article is installed around and attached to the rods or the like, of said lifted pop-up stoppers with the attachable means, and its open ends are closed with the fastening means or when the article is just fastened around said pop-up stoppers or the like, while the net-like structure or the open web allow, with a plurality of large enough openings, the free flow of running water without hair into the drainpipe opening.

OBJECTS OF THE INVENTION

Accordingly, it is one of the major objects of the present invention to provide a new article which prevents hair, hairpins, or any other object carried away with the water flow during the taking of showers or washings or the like, from entering and clogging the drainpipes of bathtubs, lavatories and the like, by means of an entangling action and a gripping action carried out by flexible spikes or bristles or by a resilient open lofty integrated web of continuous crinkled filaments, or by rough indented openings of the net-like structure, in conjunction with a blocking action carried out by the shape of the article which is shaped to be adapted to surround entirely the lifted conventional pop-up stoppers or the like of the drain control systems of bathtubs, lavatories and the like, and both said actions being exerted upon the fallen hair, hairpins or any other object carried away with the water flow, thereby preventing said fallen hair, hairpins or any other from entering and clogging said drainpipes.

It is another object of the present invention to provide an article of the above character having flexible spikes or brsitles or an open lofty integrated web of crinkled filaments on its outer face, or rough indented openings of the net-like structure, to exert an entangling and gripping action upon the fallen hair, hairpins or any other object carried away with the water flow.

It is another object of the present invention to provide an article of the above character which is shaped to surround entirely the lifted conventional pop-up stoppers or the like of the drain control systems of bathtubs, lavatories and the like in order to exert a blocking action upon the fallen hair, hairpins or any other object carried away with the water flow during the taking of showers or washings or the like.

It is another object of the present invention to provide an article of the above character which body is open ended and suitably dimensioned so as to be easily attached when installed around the lifted conventional pop-up stoppers or the like, of the drain control systems of bathtubs, lavatories and the like.

It is another object of the present invention to provide an article of the above character which body is constituted by a net-like structure with a plurality of openings which are large enough to allow the free flow of running water without hair into the drainpipes during the taking of showers or washings or the like.

It is another object of the present invention to provide an article of the above character wherein the integrated web of crinkled filaments is open to allow, through large enough openings, the free flow of running water without hair into said drainpipes.

It is another object of the present invention to provide an article of the above character having a body constituted by a net-like structure, integral with imperforate zones which are the support of attachable means and fastening means.

It is another object of the present invention to provide an article of the above character having attachable means to be affixed to the rods or the like of the lifted pop-up stoppers of the drain control systems of bathtubs, and the like, or with securing means to be affixed to the underside of the top of other standard stoppers, thereby providing a tight and secure installation.

It is another object of the present invention to provide an article of the above character having fastening means to tightly close the open ends of the article, after it has been placed around and attached to the lifted standard pop-up stoppers or the like of the drain control systems of bathtubs, lavatories and the like, thereby providing a tight and secure installation.

It is another object of the present invention to provide an article of the above character without having attachable means, in order to be fastened around said lifted conventional pop-up stoppers, with said fastening means.

It is another object of the present invention to provie an article of the above character which body, in some examples, has a flexible flat imperforate base with several preferred undersurfaces, to provide a secure installation.

It is yet another object of the present invention to provide an article of the above character which constitutes a means to actually eliminate the cause of the aforesaid problem in a simple, harmless and inexpensive way.

It is a further object of the present invention to provide an article of the above character which is easy to clean after each use and it is wear resistant, while its flexible spikes or bristles or integrated open web of continuous crinkled filaments wil retan their shape and will not rust or shed.

It is another object of the present invention to provide an article of the above character which is easy to manufacture and mass produce at low cost.

BRIEF DESCRIPTION OF THE DRAWINGS

While the Specification concludes with claims particularly pointing out and distinctly claiming the subject matter of the present invention, it is believed that the invention can be more readily understood from the following description taken in connection with the accompanying drawings, in which:

FIG. 3 is an enlarged perspective view of a transverse cross section of the preferred exemplary embodiment illustrated in FIG. 1 taken along section line 3—3 of FIG. 1, as installed around and attached to the rods of the lifted trip lever pop-up stopper of the drain control system of bathtubs, and the like.

FIGS. 23 and 24 are perspective views in large scale of preferred exemplary embodiments of spikes.

FIGS. 25, 26 and 28 are perspective views in large scale of preferred exemplary embodiments of bristles.

FIG. 27 is a perspective view in large scale of a fragmentary cross section of the preferred exemplary embodiment illustrated in FIG. 1, showing the preferred exemplary embodiment of the open web of crinkled filaments.

FIG. 29 is a perspective view of a fragmentary cross section of the preferred exemplary embodiment illustrated in FIG. 5 showing the preferred exemplary embodiment of the open web of crinkled filaments.

DETAILED DESCRIPTION OF THE PREFERRED EMBODIMENTS

Figure 1:
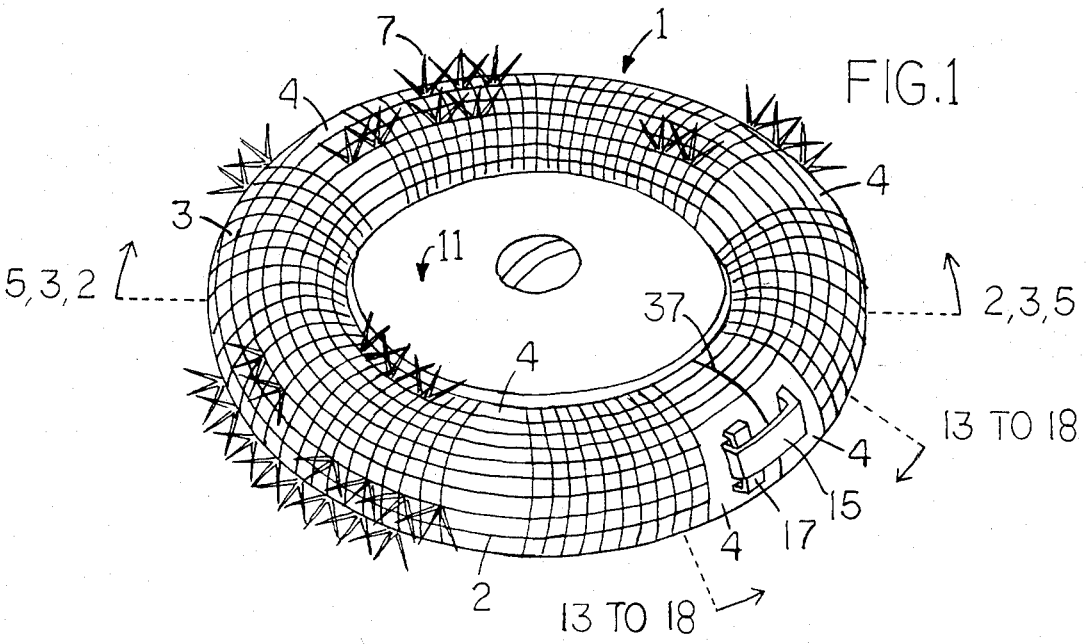
FIG. 1 is a perspective view in large scale of a preferred exemplary embodiment of the article as installed around the lifted trip lever pop-up stopper, of the drain control system of bathtubs, and the like. The preferred embodiment of the article illustrated in this figure applies to all of the preferred embodiments of spikes or bristles or open web of crinkled filaments, or rough indented openings.

While this invention is susceptible of embodiment in many different forms, there is shown in the drawings and will herein be described in detail preferred embodiments of the invention and modifications thereof, with the understanding that the present disclosure is to be considered as an exemplification of the principles of the invention and is not intended to limit the invention to the embodiments illustrated. The scope of the invention will be pointed out in the appended claims. The discussion that follows is primarily directed to the use of the invention as applied to the various conventional pop-up stoppers or the like of the drain control systems of bathtubs, lavatories and the like, such as for example, the trip lever pop-up stoppers with rods of bathtubs and the like, the pop-up stoppers of lavatories and the like, the tip toe stopper, the turnstop stopper and any other similar stoppers, although it should be understood that the present invention could also be adapted to other drain control systems and the detailed description of the invention and its use as applied to said stoppers will allow those skilled in the art to readily adapt the invention to other drain control systems.

Referring now to the drawings, the article of the present invention has a preferred circular shape which may take any of several preferred cross section forms, FIGS. 1, 5, 10, 35, 37 and 38 show the most preferred circular forms of the article. Said circular shapes are identified by the numeral 1 and differentiated by letters, such as 1, 1*a*, 1*b*, 1*b'*, 1*c* and 1*d*. The circular shapes 1*b* and 1*b'* are quite similar, except for the fact of being provided with different embodiments of attachable means, so that a similar numeral and primed letter is used. Furthermore, all the different types of stoppers are designated with the same numeral 11.

The article, in all of its preferred embodiments, is made preferably of a suiable flexible and springy plastic material, or of flexible and springy rubber, or of any other equally suitable material and it could be produced by injection molding process or by extrusion process. However, the injection molding process is considered more appropriate to obtain the preferred circular shapes of the article. If injection molding process is employed, different molds could be used, as it will be obvious to those skilled in the art as per the detailed description and drawings of the article, to obtain said most preferred circular shapes as well as the different spikes or bristles. If extrusion process is employed, different extruder dies could be used, as it will be obvious to those skilled in the art to obtain the preferred circular shapes of the article, as well as the different spikes or bristles, and they could be produced by extrusion process similar to that utilized to extrude thermoplastic articles with spikes or bristles and optionally formed flat and tubular profiles disclosed in the U.S. Pat. No. 3,329,998, issued to C. Stöhr on July 11, 1967, and in U.S. Pat. No. 3,387,069 issued to C. Stöhr on June 4, 1968, and U.S. Pat. No. 3,923,442 issued to Arno Stöhr on Dec. 2, 1975, and U.S. Pat. No. 3,867,953 issued to Arno Stöhr on Feb. 25, 1975, said patents being hereby incorporated herein by reference. Also both aforementioned processes could be used in association, and intergrating means could be employed in an additional stage to adherently bond together different features. Of course, any other equally suitable process could also be employed.

All the dimensions of the article of the present invention should be adapted to the different types of stoppers as well as to the size of stoppers used in bathtubs and the ones used in lavatories. Therefore, in the description that follows there will be given dimensions which intend to be only exemplary of one of said sizes, and which could be subject, in practice, to modifications and adjustments whenever covenient. Furthermore, all the preferred circular shapes of the article of the present invention are preferably dimensioned in such a way as to cover with its body (incuding the height of spikes, bristles or open web) the space defined between the flange and the top of the aforementiond lifted stoppers and the entire entrance to the drainpipe opening, and they are alos preferably dimensioned in such a way as to rest entirely over the flange. Some of the preferred embodiments of the article are suitable to be used in bathtubs, or the like, and some are suitable to be used in lavatories or the like, therefore there is intended a big size of the preferred embodiment of the article to be used in bathtubs and the like, and a small size to be used in lavatories and the like. In addition all the preferred circular shapes of the articles are flexible and springy but have the necessary stiffness to stay firmly in place when installed.

Referring now to FIG. 1 there is shown one of the most preferred exemplary embodiments of the article, an attachable open ended circular hollow core cylindrical shape 1 as installed around the lifted trip lever pop-up stopper 11 with rods 12 and 13 (see also FIG. 3) of bathtubs and the like, which is suitable to be used with the trip lever pop-up stopper with rods or the like, of bathtubs and the like. The circular shape 1 is constituted by a net-like structure with a plurality of openings 3, which is integral, in a preferred embodiment of imperforate zones, with five transversal imperforate strips 4, three of which are the support of attachable means (FIG. 2, only two are shown), and two of which are the support of fastening means. There is shown in FIG. 1 the hooking portion 15 and the engaging portion 17 of said fastening means, placed over the outer face of two transversal end imperforate strips 4 at the open ends 37 of the circular shape 1. The preferred embodiments of fastening means will be explained in more detail, in FIG. 1, as in most other figures, the net-like structure is simplified for clarity purposes, except in FIGS. 7, 23, 24, 25, 26 and 28, when the net-like structure is illustrated in large scale. The outer face of the net-like structure 3 and of the imperforate strips 4(except on the area where attachable and fastening means are placed), bear a plurality of external ribs 2 ending in flexible spikes 7 (only a sample is shown), of a preferred exemplary embodiment of spikes (see FIG. 24) for a greater detail) uniformly spaced at a minimal distance, keeping the same distance and disposition on the net-like structure 3, as well as on the strips 4. (The disposition of the preferred embodiment of spikes 7 will be described later in more detail). Although there are always provided spikes 7, 40 and 41 (FIGS. 24, 7 and 23) or bristles 42, 43, 44 (FIGS. 25, 26, 28) over the outer face of the strips 4 in all the preferred circular shapes 1, 1*a*, 1*b*, 1*b'*, 1*c* and 1*d* of the article, on the other hand, the external ribs 2 may be optional, (FIGS. 3, 4, 5, 10 and 30 illustrate the strips 4 without having external ribs. The entire outer face of the net-like structure 3 and the outer face of the five transversal imperforate strips 4, except where the attachable and fastening means are placed, are provided, in several preferred exemplary embodiments, with flexible spikes 7, 40 and 41, or bristles 42, 43, 44 or with an adherently bonded resilient open lofty integrated web 45 (see FIG. 27) of interengaged extruded continuous irregularly coiled large diameter filaments of thermoplastic material welded together at points of mutual contact to form the integrated open web, according with an integration treatment using commercially available liquid hardenable adhesive bonding resin, which upon hardening, permanently adheres the filaments together as a unitary structure. This liquid may be applied by immersing the web in a bath thereof or by spraying the web therewith. Such liquids may be in the form of a solvent solution of the boding resin, as a hot melt of the resin or in any other convenient form. Hardening of such liquids will of course depend upon their form. Hardening of solvent solutions will be by solvent evaporation and hardening the melt will be by cooling. The open web 45 has one of its major surfaces flattened 38, shown in FIG. 29, to provide an excellent contact surface for lamination, when it is laminated to the net-like structure 3 and to the imperforate strips 4, being both the substratum for the lamination of the web 45. The integrated open web 45 is bonded to the outer face of the plastic net-like structure with a plurality of openings 3 and also to the outer face of the five transversal imperforate strips 4 except on the area where attachable and fastening means are placed, that constitute the body of the attachable open ended circular hollow cylindrical shape 1, using conventional adhesives, and coating the flattened surface 38 (FIG. 29) of the web with the liquid hardenable adhesive by any convenient means, e.g. brush, spray or roll coating and pressing the net-like substrate against the adhesive coated surface with light or moderate pressure. Once the adhesive cures, the web and substrate become permanently adherently bonded together. The web could also be bonded without using adhesives by having the molten thermoplastic filaments fall upon the outer surface of the net-like structure 3 as well as upon the outer surface of the five transversal imperforate strips 4 and upon cooling, form an adherently bond between the substrate surface and the web. Although this latter treatment may be less practical due to the form of the article of the present invention. It should be understood that although the open web is adherently bonded to the outer face of the attachable open ened circular hollow cylindrical shape 1 according with conventional laminaton treatments, the result is not defined hrein as a dimensionally stable laminate since this is not the case of a sheet-like laminate. Optionally, in another embodiment of the open web 45, the web 45 comprises abrasive filaments, and yet in another preferred embodiment the web 45 comprises foamed filaments, so that the filaments could exert also a gripping action over the fallen hair which have been entangled within the eb 45. To produce these other preferred embodimenst of filaments the completed web is modified prior to integration or lamination by the addition of particulate materials such as abrasive grains to produce abrasive filaments or by the addition of gases or blowing agents to produce foamed filaments. Also the completed web may be modified by any other means equally suitable to obtain filaments with the desired gripping action. The open lofty integrated web 45 of interengaged extruded continuous crinkled large diameter filaments is preferably subjected to extrusion process, and modification treatments to produce abrasive and foamed filaments, as well as integration and lamination treatments similar to those utilized to extrude filaments as well as to integrate and laminate the open web of filaments or to produce abrasive and foamed filaments disclosed in the U.S. Pat. No. 3,837,988 issued to D. E. Hennen et al on Sept. 24, 1974, said patent being hereby incorporated herein by reference.

Whereas the teachings of the hereinbefore incorporated U.S. Pat. No. 3,837,988 are concerned with applications of the open web to a composite mat especially suited for use as a floor covering, the intended use of the open web in the present invention is as a means to avoid the clogging of drainpipes of bathtubs, lavatories and the like, through the entangling action exerted by said open web of crinkled filaments upon the fallen hair, hairpins or any other object carried away with the water flow during the taking of showers or washings or the like, while the openness of the web serves the purpose of allowing the free flow of running water into the drainpipe opening.

The description of the open web 45 and the reference to its related manufacturing process such as have been given for the attachable open ended circular hollow cylindrical shape 1 are equally applicable to all the preferred circular shapes 1, 1*a*, 1*b*, 1*b'*, 1*c* and 1*d* of the article.

First there will be described for this preferred circular shape 1 as well as for the circular shapes 1*a* and 1*b* of the article, attachable means suitable to be used with the trip-lever pop up stopper provided with rods of the drain control systems of bathtubs and the like. The accompanying drawings illustrate the attachable means as applied to long rods (see FIGS. 3, 5, 8, 9, 11 and 12) which extend below the flange level, although a change in dimensins of said attachable means will readily adapt them to be used with shorter rods which extend slightly above the flange.

Figure 2:
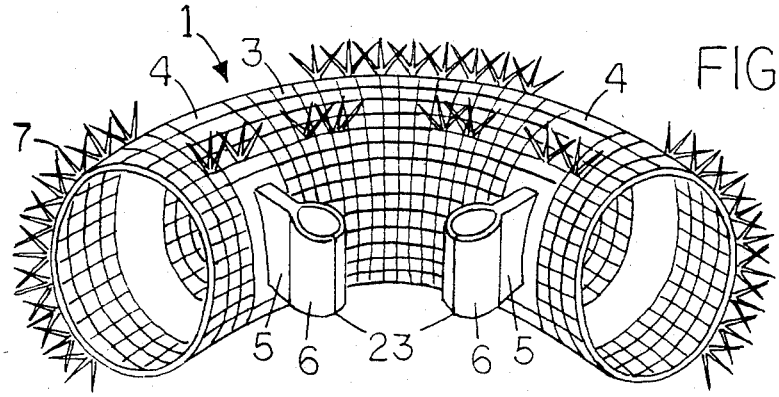
FIG. 2 is an enlarged perspective view of a transverse cross section of the preferred exemplary embodiment illustrated in FIG. 1, taken along section line 2—2 of FIG. 1, showing a preferred embodiment of attachable means.
Figure 3:
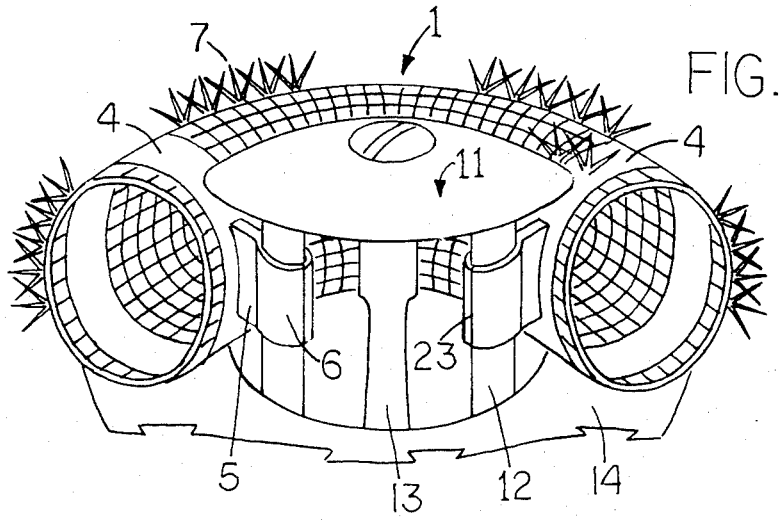

Referring now to FIG. 2, the net-like structure with a plurality of openings 3 which constitutes said attachable open ended circular hollow cylindrical shape 1, is integral in a preferred embodiment of imperforate zones, with the five transversal imperforate strips 4 (only two strips 4 are shown in FIGS. 2 and 3) which extend, in a preferred embodiment, continuously on the net-like structure 3 all around and transversally to the attachable open ended circular hollow cylindrical shape 1. As it has been previously mentioned, three of the five imperforate strips 4 are the support for the placement of attachable means comprising grippers 6, and two of the five imperforate strips 4 placed at the open ends of the circular shape 1, are the support of fastening means. The two transversal end imperforate strips 4 are located, in this preferred embodiment of five imperforate strips 4, preferably half-way between two of the other three imperforate strips 4 (see FIG. 1). Turning now to FIG. 3, each one of the three transversal imperforate strips 4 bear on its outer face one gripper 6 transversally oriented in reference to the body of the circular shape 1 placed concentrically oriented over the inner circumference of the circular shape 1, facing the rods 12 of the lifted trip lever pop-up stopper 11, in order to grip the rods 12. There is also shown the central rod 13. Each gripper 6 comprises an elongated portion 5 with a preferred approximately solid rectangular shape integral with a hollow preferably cylindrical gripper 6, and the approximately rectangular solid portion 5 /is placed in a preferred embodiment longitudinally to the hollow cylindrical gripper 6 as illustrated in this FIG. 2 as well as in FIGS. 3, 4, 27 and 31, and is united along its sides to the gripper 6 and to the hollow cylindrical shaped body of the article over the imperforate strips 4. The gripper 6 has a vertical slit 23 which opens to grip the rods 12 and the gripper 6 is flexible but has the necessary stiffness to tightly grip said rods 12, when the circular shape 1 is installed around and attached to the lifted standard trip lever pop-up stopper 11.

Figure 9:
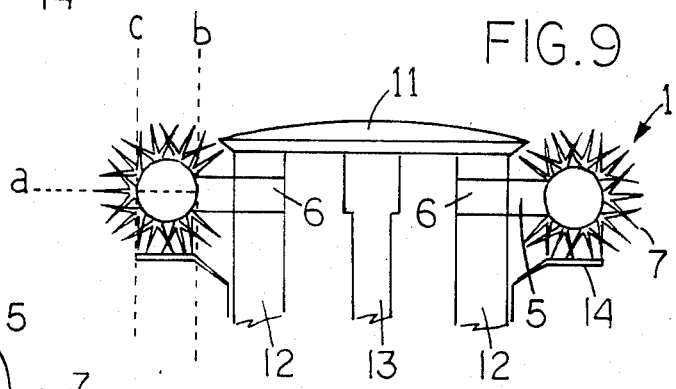
FIG. 9 is a simplified partial schematic cross section view of the preferred exemplary embodiment illustrated in FIG. 1 as installed around and attached to the rods of the lifted trip lever pop-up stopper resting entirely over the flange, showing the area where attachable and fastening means are located and the disposition of spikes extending up to the attachable means. This figure is scaled to about the actual size used on bathtubs.

Referring now to FIG. 9 the solid rectangular portions 5 of the grippers 6 are placed on the outer face of the transversal imperforate strips 4 over the inner circumference of the circular shape 1, at the point of intersecton of the horizontal diameter a of the hollow cylindrical shape 1, with a vertical tangent line b which is perpendicular to the horizontal diameter a, at which point of intersection a—b the solid rectangular portion 5 extends symmetrically above and below the point of intersection a—b a suitable length adapted to the height of the rods 12 of the lifted trip level pop-up stopper 11. As mentioned before the two transversal end imperforate strips 4, placed at the open ends of the circular shape 1, bear on their outer face and over the outer circumference of the circular shape 1, any one of several preferred exemplary embodiments of fastening means to tightly close its open ends (see FIG. 1). The preferred embodiments of fastening means will be explained later in more detail, as well as its location at the point of intersection a—c shown in FIG. 9. Also shown in FIG. 9 is an arrangement of spikes 7 preferably extending up to the solid rectangular portion 5 of the gripper 6 (and also up to the fastening means, not shown). This disposition is also applicable to bristles 42, 43, 44 and web 45.

The diameter of the cylindrical body of the attachable open ended circular hollow core cylindrical shape 1, including the height of spikes 7, 40, 41, bristles 42, 43, 44, or web 45, is preferably such as to adapt to the space defined between the flange 14 and the top of the lifted trip lever pop-up stopper with rods or the like, and to cover the entire entrance to the drainpipe opening with its body, including the height of spikes 7, 40, 41, bristles 42, 43, 44, or web 45, and the inner circumference of the circular shape 1, including the spikes 7, 40, 41, bristles 42, 43, 44, or web 45, is preferably such as to surround closely the rods or the like of the trip lever pop-up stopper with rods or the like, in order to be attached to the rods or the like of said lifted stoppers, and the inner and outer circumferences of the circular shape 1, including the spikes 7, 40, 41, bristels 42, 43, 44, or web 45, are preferably such as to adapt to the inner and outer circumferences of the flange 14, so that the circular shape 1 preferably rests entirely over the flange 14 as illustrated in FIG. 9. There is given an example of dimensions for the circular shape 1 adapted to the trip lever pop-up stopper with rods of bathtubs and the like; diameter of the outer circumference of the circular shape 1 (excluding spikes 7, 40, 41, or bristles 42, 43, 44, or web 45) preferably approximately 31/16", diameter of the inner circumference of the circular shape 1 (excluding spikes 7, 40, 41, bristles 42, 43, 44, or web 45) preferably approximately 25/16", diameter of the cylidrical body (excluding spikes 7, 40, 41, bristles 42, 43, 44, or web 45) preferably approximately $\frac{3}{8}$", height of spikes 7, 40, 41, bristels 42, 43, 44, or web 45 preferably approximately $\frac{1}{4}$", diameter of the cylindrical body (including spikes 7, 40, 41, or bristles 42, 43, 44, or web 45) preferably approximately $\frac{7}{8}$", width of imperforate strips 4 preferably approximately $\frac{3}{8}$", gripper 6; width of soli rectangular portion 5 preferably approximately $\frac{1}{4}$", height of the solid rectangular portion 5 preferably approximately $\frac{1}{4}$", and thickness preferably approximately 3/16". Hollow cylindrical gripper 6; diameter preferably approximately 5/16", height preferably approximately $\frac{1}{4}$".

Figure 4:
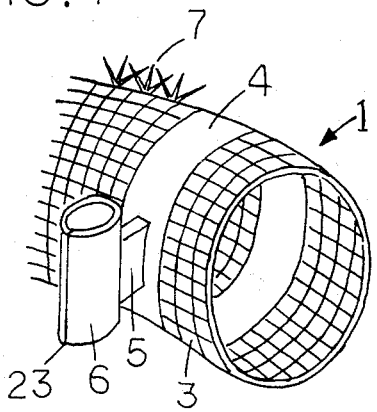
FIG. 4 is an enlarged perspective view of a fragmentary cross section of the preferred exemplary embodiment illustrated in FIG. 1 showing another exemplary embodiment of the attachable means.

FIG. 4 illustrates another preferred embodiment of a gripper 6 wherein the gripper 6 is longer than the solid rectangular portion 5. There is also shown the strip 4 and a sample of spikes 7 of a preferred exemplary embodiment.

Figure 5:
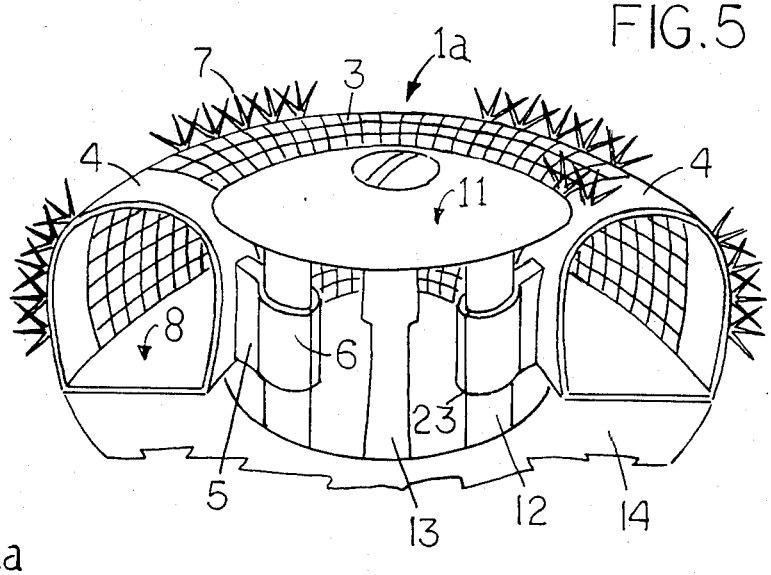
FIG. 5 is an enlarged perspective view of a transverse cross section of another prefrred embodiment of the article taken along section line 5—5 of FIG. 1. Although the embodiment shown in FIG. 1 is not the same embodiment shown in this figure, the same cross section view is applicable to both embodiments of the article as they are quite similar for illustrative purposes. The preferred embodiment of the article illustrated in this figure applies to all of the preferred exemplary embodiments of spikes or bristles or open web of crinkled filaments, or rough indented openings.
Figure 8:
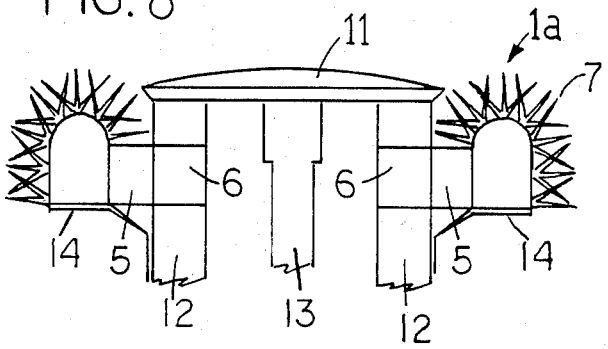
FIG. 8 is a simplified partial schematic cross section view of the preferred embodiment illustrated in FIG. 5, as installed around and attached to the rods of the lifted trip lever pop-up stopper resting entirely over the flange, showing the disposition of spikes extending up to the attachable means. This figure is scaled to about the actual size used on bathtubs.

FIG. 5 illustrates another most preferred exemplary embodiment of the article: an attachable open ended circular hollow core semicylindrical shape 1*a* as installed around the trip lever pop-up stopper 11, griping the rods 12. There is also shown the central rod 13. The circular shape 1*a* is suitable to be used with the trip lever pop-up stopper with rods or the like, of bathtubs and the like. The circular shape 1*a* comprises an upper portion or circular hollow core semicylinder constituted by a net-like structure with a plurality of openings 3 integral, in a preferred embodiment of imperforate zones, with the five transversal imperforate strips 4 which are the support of the attachable means and of the fastening means, and the upper portion or circular hollow core semicylinder is integral with a circular flexible flat thin imperforate lower portion which constitues the base 8 or the article, providing one adhesive undersurface 9 with removable backing paper 10 (FIG. 6) which is entirely coated with any conventional commercially available pressure-sensitive adhesive compatible with the plastic material used, which adhering properties are suitable for porcelain, cast-iron, steel, fiberglass and other plastic surfaces of bathtubs, lavatories and the like, or another optional plain undersurface (not shown). The base 8 preferably rests entirely over the flange 14, as shown in FIG. 8. The outer face of the net-like structure 3 and the outer face of the five transversal imperforate strips 4 bear a plurality of external ribs 2 ending in spikes 7 of a preferred exemplary embodiment (only a sample is shown) uniformly spaced at a minimal distance from each other keeping the same distance and disposition on both the net-like structure 3 as well as over the strips 4. Internal ribs 2' (see FIG. 24) support the whole body of the attachable open ended circular hollow core semicylindrical shape 1*a*. The outer face of the net-like structure 3 and of the imperforate strips 4 is provided, in several preferred exemplary embodiments, with the flexible spikes 7, 40, 41, or bristles 42, 43, 44, with the adherently bonded resilient open lofty integrated web 45 (see FIG. 29) of interengaged extruded continuous crinkled unmodified or modified abrasive or foamed large diameter filaments.

The net-like structure with a plurality of openings 3 which constitutes the upper portion or hollow core semicylinder of the attachable open ended circular shape 1*a* is integral, in a preferred embodiment of imperforate zones, with the five transversal imperforate strips 4 which extend, in a preferred embodiment, continuously on the net-like structure 3 and transversally to said circular hollow core semicylindrical shape 1*a* from the inner edge of the flat imperforate lower portion or base 8 over the upper portion or hollow core semicylinder to the outer edge of said base 8. Three of the five imperforate strips 4 are the support for the placement of attachable means comprising grippers 6 and two of the five imperforate strips 4, placed at the open ends of said circular shape 1*a* are the support of fastening means. The two transversal end imperforate strips 4 are located in this preferred embodiment of five imperforate strips 4, preferably half-way between two of the other three imperforate strips 4.

Figure 6:
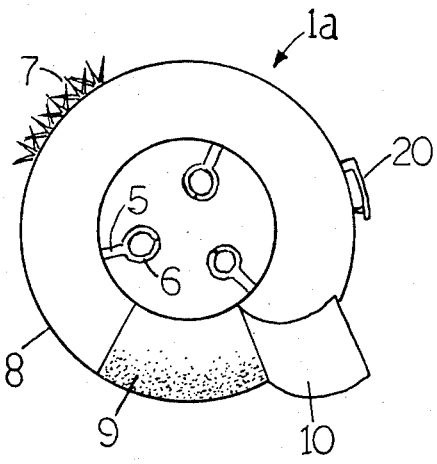
FIG. 6 is a plan view of the base of the preferred embodiment illustrated in FIG. 5 showing an adhesive undersurface. The undersurface of the preferred embodiment illustrated in this figure optionally applies to all of the preferred exemplary embodiments of spikes or bristles or open web of crinkled filaments or rough indented openings.

Each one of the three transversal imperforate strips 4 bears on its outer face one gripper 6, previously described for the circular shape 1, (only two grippers 6 are shown in FIG. 5), placed transversally oriented in reference to the body of said circular shape 1*a* concentrically oriented over the inner circumference of this circular shape 1*a*, facing the rods 12 of the lifted trip lever pop-up stopper 11, in order to grip said rods 12. The solid rectangular portion 5 is placed, in a preferred embodiment, longitudinally to the hollow cylindrical gripper 6 as illustrated in FIG. 5, as well as in FIGS. 29 and 30, and is united along its sides to the gripper 6 and to the hollow core semicylindrical shaped body of the article over the imperforate strips 4. The solid rectangular portions 5 of the grippers 6 are placed on the outer face of the transversal imperforate strips 4, at the level of the base 8, on its inner edge, and extend upwards up to a suitable height as shown in FIG. 8. Also shown in FIG. 8 is an arrangement of spikes 7 preferably extending up to the solid rectangular portion 5 of the gripper 6 (and also up to the fastening means not shown). This disposition is also applicable to bristles 42, 43, 44 and web 45. The outer face of the two transversal end imperforate strips 4 bear any one of several preferred exemplary embodiments of fastening means oriented over the outer circumference of the attachable open ended circular shape 1*a* in order to tightly close its open ends, as illustrated in FIG. 6 showing the hooking portion 20, of one of the most preferred embodiments of fastening means. There are also shown in FIG. 6 three grippers 6 integral with the solid rectangular portions 5 over the inner circumference of the circular shape 1*a*.

The height of the attachable open ended circular hollow core semicylindrical shape 1*a*, including the height of spikes 7, 40, 41, bristles 42, 43, 44, or web 45, is preferably such as to adapt to the space defined between the flange and the top of the lifted trip lever pop-up stopper with rods or the like, and to cover the entire entrance to the drainpipe opening with its body including the height of spikes 7, 40, 41, bristles 42, 43, 44, or web 45, and the inner circumference of the circular shape 1*a*, including the spikes 7, 40, 41, bristles 42, 43, 44, or web 45, is preferably such as to surround closely the rods or the like of the lifted trip lever pop-up stopper with rods or the like, in order to be attached to the rods or the like, of said lifted stopper, and the inner and outer circumferences of the circular flat imperforate base 8 are preferably such as to adapt to the inner and outer circumferences of the flange 14, to permit a secure installation of the base 8 over the flange 14, as illustrated in FIG. 8. There is given an example of dimensions for the circular shape 1*a* adapted to one of the existing trip lever pop-up stoppers with rods of bathtubs and the like: diameter of the outer circumference of the base 8, preferably approximately 33/16", diameter of the inner circumference (excluding spikes 7, 40, 41, bristles 42, 43, 44, or web 45) preferably approximately $2\frac{3}{8}$", height of the semicylinder (excluding spikes 7, 40, 41, bristles 42, 43, 44, or web 45) preferably approximately 9/16", height of spikes 7, 40, 41, or bristles 42, 43, 44 or web 45, preferably approximately $\frac{1}{4}$", total height of hollow core semicylinder (including spikes 7, 40, 41, or bristles 42, 43, 44, or web 45) preferaby approximately 13/16", width of base 8 preferably approximately $\frac{3}{8}$", width of transversal imperforate strips 4 preferably approximately $\frac{3}{8}$"; grippers 6; solid rectangular portion 5; width preferably approximately $\frac{1}{4}$", height preferably approximately $\frac{3}{8}$", thickness perferably approximatly 3/16"; hollow cylindrical gripper 6; diameter preferably approximately 5/16", height preferably approximately $\frac{3}{8}$".

Figure 10:
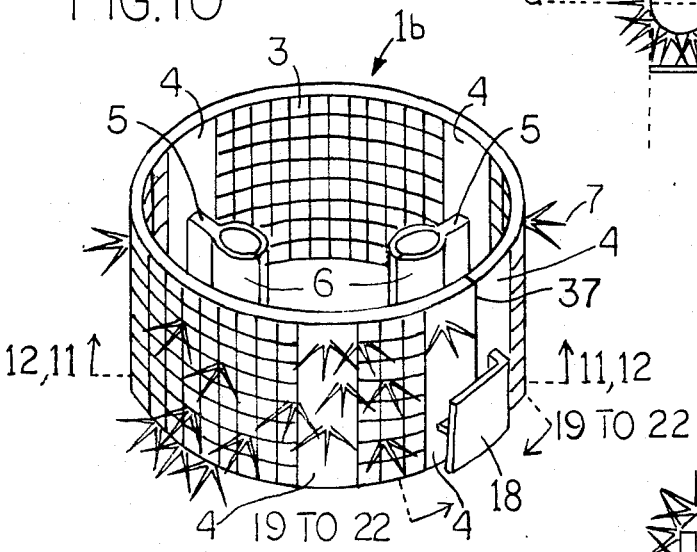
FIG. 10 is a perspective view of another preferred exemplary embodiment of the article. The preferred embodiment of the article illustrated in this figure applies to all the other preferred embodiments of spikes or bristles or open web of crinkled filaments or rough indented openings.

Referring now to FIG. 10, there is shown another most preferred exemplary embodiment of the article, an attachable open ended circular vertical strip-like shape 1*b*. The circular shape 1*b* provided with gripper 6, as illustrated in this figure, is suitable to be used with the trip lever pop-up stopper with rods, or the like, of bathtubs and the like, and is constituted by a net-like structure with a plurality of openings 3, which is integral, in a preferred exemplary embodiment of imperforate zones, with five transversal imperforate strips 4, which are the support for the placement of attachable and fastening means. The entire outer face of the net-like structure 3 and the outer face of the five transversal imperforate strips 4, except on the area where the attachable and fastening means are placed, are provided, in several preferred exemplary embodiments, with the flexible spikes 7, 40, 41, or bristles 42, 43, 44, or with the adherently bonded resilient open lofty integrated web 45 (see FIG. 22) of interengaged extruded continuous crinkled unmodified or modified abrasive or foamed large diameter filaments.

Figure 11:
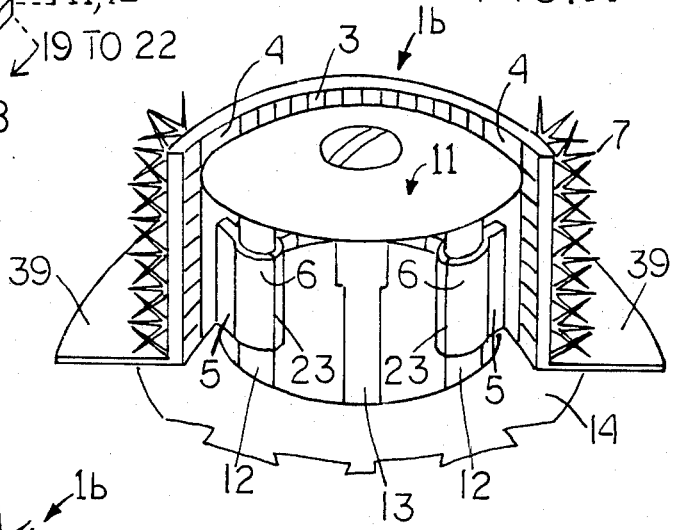
FIG. 11 is a perspective view of a transverse cross section view of the preferred exemplary embodiment illustrated in FIG. 10 taken along section line 11—11 of FIG. 10 as installed around and attached to the lifted pop-up stopper showing an optional flat imperforate base.
Figure 12:
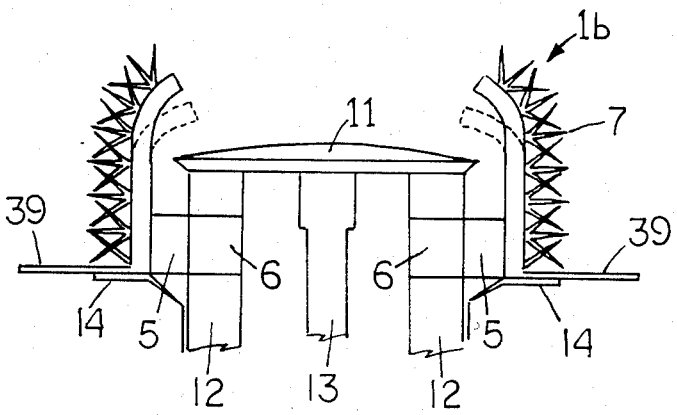
FIG. 12 is a simplified schematic transverse cross section view partially in phantom of the, preferred exemplary embodiment illustrated in FIG. 10, taken along section line 12—12 of FIG. 10, showing said embodiment with a modified upper portion and with an optional imperforate base. This figure is scaled to about the actual size used on bathtubs.

The upper portion of the attachable open ended circular vertical strip-like shape 1*b* is, in a preferred embodiment, straight (FIGS. 10 and 11) and in another preferred embodiment, said upper portion is curved inwards (FIG. 12). The straight upper portion of the circular shape 1*b* preferably should suitably exceed the height of the top of the stopper 11 (FIG. 11) and the curved upper portion preferaby should extend a suitable distance above and over the top of the stopper 11 while the curve may vary in sharpness, bending more or less closely over the top of the lifted pop-up stopper 11, as shown in phantom in FIG. 12. As mentioned before, the net-like structure with a plurality of openings 3 which constitutes the attachable open ended circular vertical strip-like shape 1*b* is integral, with five transversal imperforate strips 4 which extend, in a preferred embodiment, continouly on the net-like structure 3 and transversally to the vertical strip-like shape 1*b* from the lower edge up to the upper edge of the circular shape 1*b*. Three of the five imperforate strips 4 are the support for the placement of attachable means and two of the five imperforate strips 4 placed at the open ends of said circular shapes 1*b* are the support of fastening means. The two transversal end imperforate strips 4 are located in this prefered embodiment of five imperforate strips 4, preferably half way between two of the other three imperforate strips 4. Each one of the three transversal imperforate strips 4 bears on its inner face one gripper 6. FIG. 10 shows a partial view of only two grippers 6 placed transversally oriented in reference to the body of the circular shape 1*b* and concentrically oriented over its inner circumference facing the rods 12 of the lifted trip lever pop-up stopper 11, in order to grip the rods 12, as shown in FIGS. 11 and 12. The solid rectangular portion 5 of the gripper 6 is placed, in a preferred embodiment, longitudinally to the hollow cylindrical gripper 6 (see also FIGS. 11 and 12) and is united along its sides to the grippers 6 and to the strip-like shaped body of the article over the imperforate strips 4. Th solid rectangular portions 5 of the grippers 6 are placed on the inner face of each one of the three transversal imperforate strips 4 at the level of the lower edge of the strip-like shape 1*b*, extending upwards up to a suitable height. The outer face of the two transversal end imperforate strips 4 bears any one of several preferred exemplary embodiments of fastening means, placed on the outer circumference of this strip-like shape 1*b*, in order to tightly colse its open ends. FIG. 10 shows the hooking portion 18 (see also FIG. 20). The height of the circular shape 1*b* is preferably such as to suitably exceed the height of the top of the pop-up stopper with rods or the like, in order to offer a barrier against the fallen hair, hairpins of any other object and to cover with its body the entire entrance to the drainpipe opening. And the inner circumference of the attachable open ended circular vertical strip-like shape 1*b* is suitably dimensioned in order to adapt to the inner circumference of the flange, so that the article can be attached to the rods (or the like) of said lifted stoppers and permit a secure installation of the circular shape 1*b* over the flange 14 as illustrated in FIG. 12. Optionally, in another preferred embodiment, the circular shape 1*b*, is integral with an outwardly directed surrounding open ended flat thin quite flexible circular imperforate base 39 having a circular central hole defined therein of a size generally corresponding to that of the drainpipe opening, (see FIGS. 11, 12, 32 and 34). In a preferred embodiment, the base 39 covers only the flange 14, and in another preferred embodiment it covers the flange and also extends a suitable distance over the surrounding area adjacent to the outer perimeter of the flange 14, and provides one adhesive undersurface or an optional plain self sealing undersurface (not shown).

There is given an example of dimensions for the circular shape 1*b* adapted to one of the existing trip lever pop-up stoppers with rods of bathtubs and the like: diameter of the outer circumference of the circular shape 1*b* (excluding spikes 7, 40, 41, bristles 42, 44, 43, or web 45) preferably approximately $2\frac{5}{8}$", diameter of the inner circumference of the circular shape 1*b* (excluding spikes 7, 40, 41, bristles 42, 43, 44 or web 45) approximately $2\frac{3}{8}$", height of the strip-like shape 1*b* with straight or curved upper portion alike, between about $1\frac{1}{4}$" to $1\frac{1}{2}$", thickness of the strip-like shape 1*b* preferably approximately $\frac{1}{8}$", height of spikes 7, 40, 41, bristles 42, 43, 44 or open web 45, between about $\frac{1}{4}$" to $\frac{1}{2}$", width of strip 4 preferaby approximately $\frac{3}{8}$". The dimensions of the three grippers 6 are the same as the dimensions that have been given in FIG. 6 for the attachable open ended circular hollow core semicylindrical shape 1*a*, width of the optional base 39, exending over the surrounding area adjacent to the outer perimeter of the flange 14, preferably approximately $1\frac{3}{8}$".

The most preferred attachable open ended circular shapes 1, 1*a*, and 1*b* and the preferred circular shapes 1*b*" (FIG. 35), 1*c* (FIG. 37) and 1*d* (FIG. 38) which will be described later on, are provided with anyone of several preferred exemplary embodiments of fastening means. FIGS. 13 through 22 illustrate the preferred embodiments of fastening means, although any other type of fastening means could also be used in order to close the open ends of the aforementioned circular shapes 1, 1i a, 1*b*, 1*b'*, 1*c* and 1*d*. The description that follows referes to the circular shapes 1, 1*a* and 1*b* although it is also applicable to the circular shapes 1*b'*, 1*c* and 1*d*. The most preferre exemplary embodiments of fastening means are placed as has been previously mentioned, over the outer circumference of the attachable open ended circular shapes 1, 1*a* and 1*b*, on the outer face of two transversal end imperforate strips 4 which are placed at the open ends of said preferred circular shapes 1, 1*a* and 1*b* and are located, in the preferred embodiments of five imperforate strips 4, at approximately half way between two of the three imperforate strips 4 which are the support of the attachable means.

Any one of the most preferred embodiments of fastening means comprises a hooking portion 15, 18 or 20, and a receiving portion 16, 17, 19 or 21 (FIGS. 13 to 22). Each one of the hooking portions 15, 18, or 20 and the receiving portion 17, is comprised in turn of different portions identified by the corresponding numeral of the hooking portion or of the receiving portion, and differentiated by letters. The hooking portions 15, 18 or 20 are configured to define a hook-like shaped portion 15 (see FIGS. 13, 13*a*, 16 and 19) or an anchor-like shaped portion 18 (see FIGS. 14, 14*a*, 17 and 20) or an insertable round portion 20 (see FIGS. 15, 18, 21 and 22). The receiving portion can be an engaging portion 17 to be engaged with the hooking portion 15 (FIGS. 13*a*, 16 and 19) or a perforated receiving slit 16 (FIG. 13) or 19 (FIGS. 14, 14*a*, 17, 20) or a perforated round opening 21 (FIGS. 15, 18, 21, 22). While the hooking portion 15, 18, 20 is placed on one of the transversal end imperforate strips 4, the receiving portion 16, 17, 19 or 21 is placed on the opposite transversal end imperforate strip 4.

Figure 13:
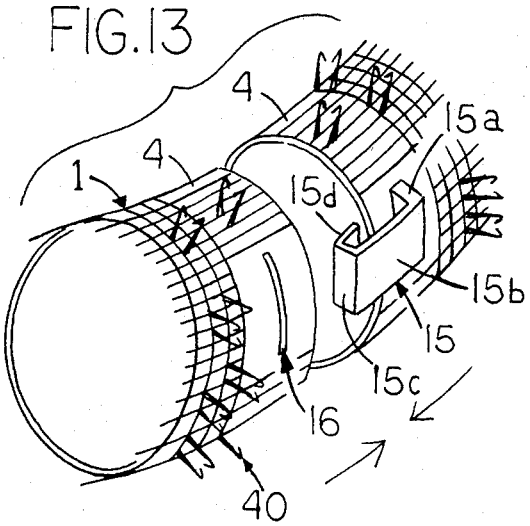
FIGS. 13 to 15 are simplifed perspective view of an enlarged cross section view of the preferred exemplary embodiment illustrated in FIG. 1, taken along section line 13–18 of FIG. 1, showing preferred exemplary embodiments of fastening means.
Figure 13A:
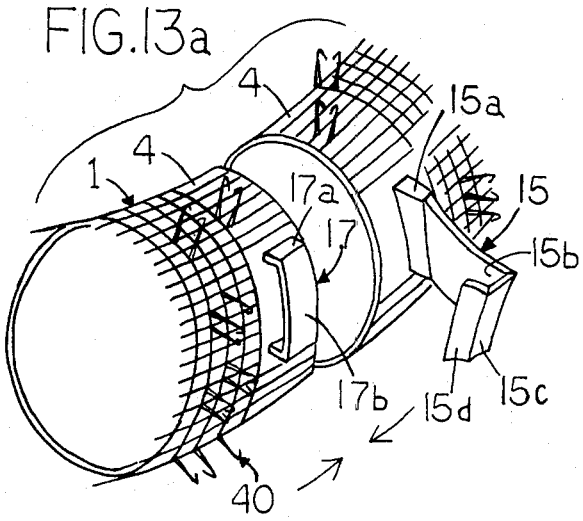

In reference to FIGS. 13 and 13*a* there are shown two positions of the hooking portion 15. Simiarly, in FIGS. 14 and 14*a* there are shown two positions of the hooking portion 18, while FIGS. 15 to 22 illustrate the open position only.

All of the different types of fastening means afe flexible enough for opening and closing motions but have the necessary stiffness for firmly engaging the hooking portion 15, 18 or 20 with the receiving portion 16, 17, 19 or 21.

Figure 14:
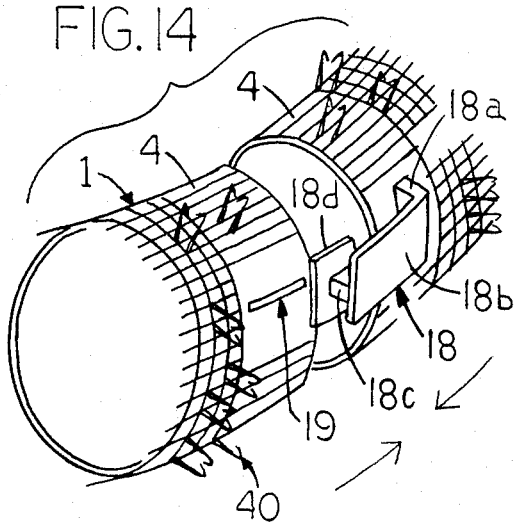
Figure 14A:
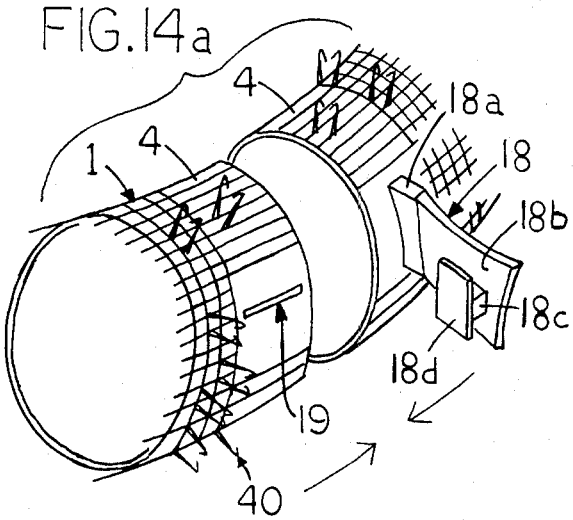
Figure 15:
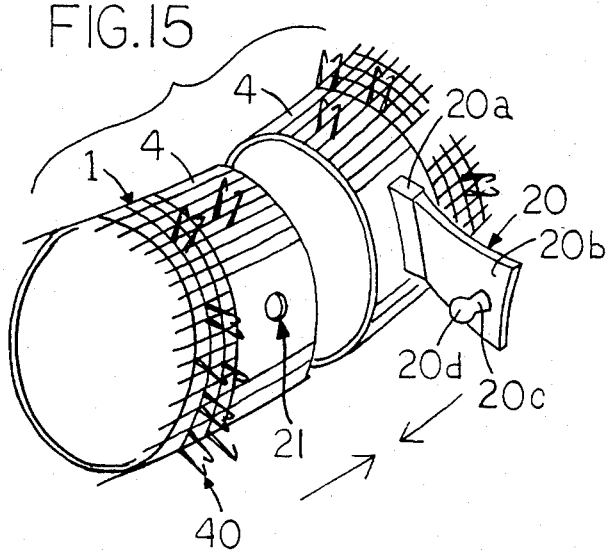

Referring now to FIGS. 13 to 15 the hooking portion 15, 18 or 20 and the engaging portion 17 are placed, on the outer face of one of the two transversal end imperforate strips 4, over the outer circumference of the circular shape 1, at the point of intersection determined by the horizontal diameter a (see FIG. 9) of the hollow core cylindrical body of the circular shape 1, with a vertical tangent line c (which is perpendicular to the horizontal diameter a at which point of intersection a—c said hooking portion 15, 18 or 20 and said engaging portion 17 extends symmetrically above and below the point of intersection a—c, a suitable height so as to permit an effectie closing of the open ends of said circular shape 1.

Figure 16:
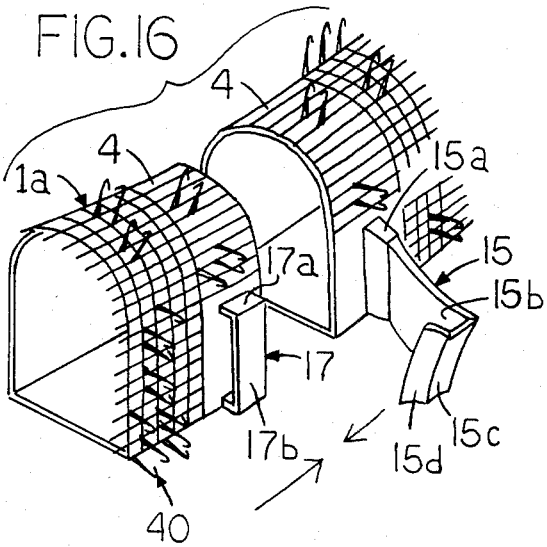
FIGS. 16 to 18 are simplified perspective view of an enlarged cross section view of the preferred exemplary embodiment illustrated in FIG. 5, taken along section line 13–18 of FIG. 1. Although the embodiment shown in FIG. 1 is not the same embodiment shown in this figure, the same cross section view is applicable to both embodiments of the article as they are quite similar for illustrative purposes. These figures show preferred exemplary embodiments of fastening means.
Figure 17:
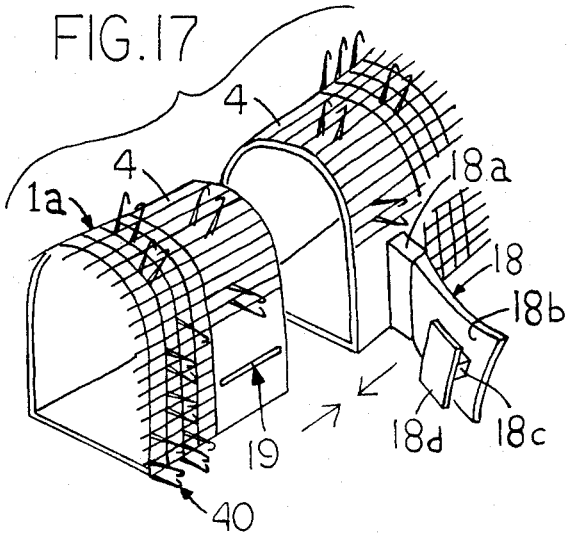
Figure 18:
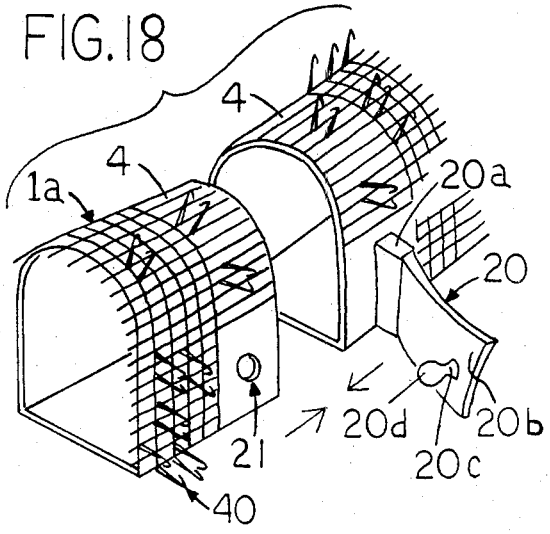
Figure 19:
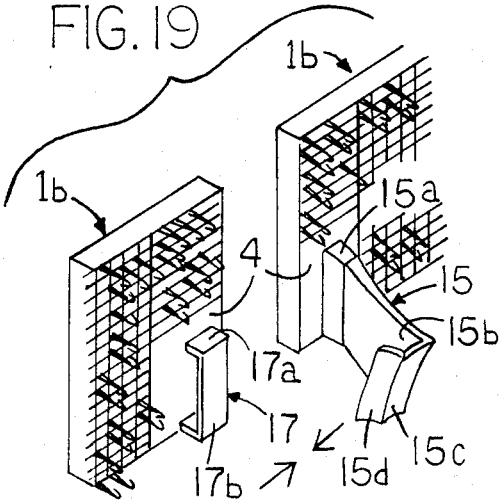
FIGS. 19 to 21 are simplified perspective view of an enlarged cross section of the preferred exemplary embodiment illustrated in FIG. 10 taken along section lines 19–22 of FIG. 10 showing preferred exemplary embodiments of fastening means.
Figure 20:
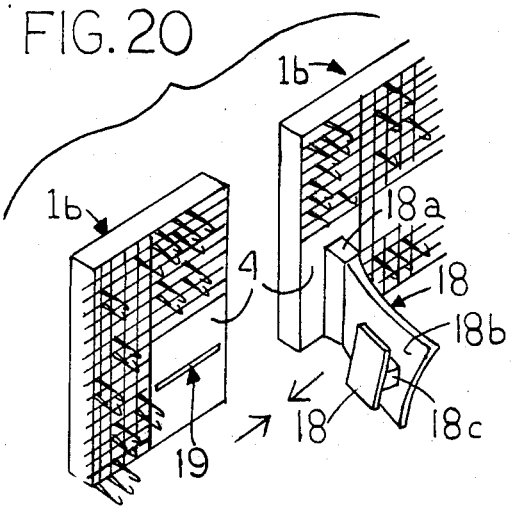
Figure 21:
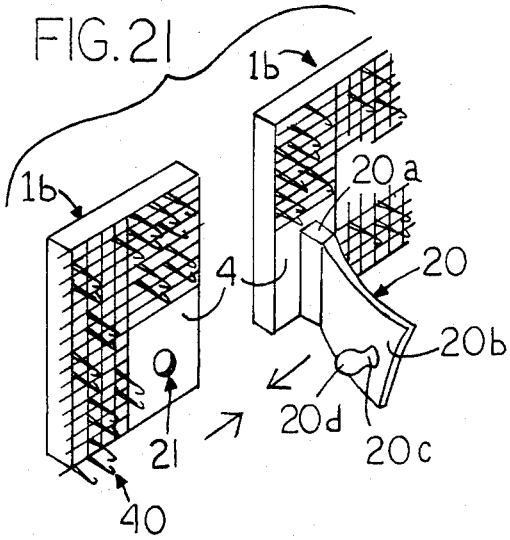

Turning now to FIGS. 16 to 18, the hooking portion 15, 18 or 20 are placed on the outer face of one of the two transversal end imperforate strips 4 over the outer circumference of the circular shape 1*a*, at the level of the base 8 on its outer edge and the hooking portion 15, 18 or 20 extend upwards, over the imperforate strips 4 up to a suitable height so as to permit an effective closing of the open ends of the circular shape 1*a*. Referring now to FIGS. 19 to 21, the hooking portions 15, 18 or 20 are placed on the outer face of one of the two transversal end imperforate strips 4 over the outer circumference of the circular shape 1*b*, at the lower edge of the vertical strip-like shape 1*b*, and the hooking portions 15, 18 or 20 also extend upwards up to a suitable height. For both circular shapes 1*a* and 1*b* the placement of the hooking portions 15, 18 or 20 is also appicable to the engaging portion 17. There is given an example of the overall dimensions of the preferred embodiments of fastening means for the preferred circular shapes 1, 1*a* and 1*b*. For the preferred circular shape 1 the overall dimensions of the hooking portions 15, 18 and 20 preferably are: length approximately $\frac{1}{2}''$ and height approximately $\frac{1}{4}''$, and for the preferred circular shapes 1*a* and 1*b* the overall dimensions of the hooking portion 15, 18 and 20 are: length approximately $\frac{1}{2}''$ and height approximately $\frac{3}{8}''$. The dimensions of the receiving portion 17 should be adapted to the dimensions of the hooking portion 15 in all the preferred circular shapes 1, 1*a* and 1*b*, and the width of the strip 4 in all the preferred embodiments of fastening means for all the preferred circular shapes 1, 1*a* and 1*b* is approximately $\frac{3}{8}''$.

Figure 7:
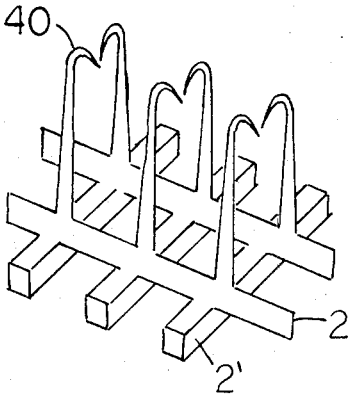
FIG. 7 is a perspective view in large scale of a preferred exemplary embodiment of spikes.

Referring now to the preferred embodiments of spikes 7, 40, 41, bristles 42, 43, 44 which are provided oer the outer face of the preferred circular shapes 1, 1*a*, 1*b*,1*c* and 1*d*, uniformly spaced at a minimal distance from each other, there is shown in FIG. 7 the external ribs 2 of the net-like structure 3 ending in spikes 40 (or bristles, not shown) with Burdock-kike hooked tips wherein pairs of adjacent spikes 40 (or bristles) are bent against each other. Internal ribs 2' support said external ribs 2.

FIG. 23 illustrates the external ribs 2 of the net-like structure 3 ending in spikes 41 with straight tips and the internal ribs 2'.

FIG. 24 illustrates the external ribs 2 of the net-like structure 3 ending in spikes 7 with straight tips which are disposed in groups of three spikes 7 radially arranged preferably on a same plane on the external ribs 2, keeping the same spacing and dispositon over the entire outer face of the net-like structure 3 as over the imperforate strips 4 of the circular shapes 1, 1*a* an 1*b*. Each group of three spikes opposes each other diagonally and alternately according to the following disposition: every two parallel external ribs 2, said groups of three radially disposed spikes 7 are spaced at a minimal ditance from each other group, preferably at the intersection of the external and internal ribs 2 and 2' of the net-like structure 3, and every two intercalated parallel external ribs 2 the radially disposed groups of spikes are spaced at a minimal distance from each other group, preferaby at the middle of each of the segments of the external ribs 2 that are so determine by two of the said intersections. The middle spikes 7 of each group of three spikes 7 is perpendicular to the external ribs 2 and the other two spikes 7 of each group of spikes 7 are at an angle 22 to the external rib 2, so that the outer spikes 7 of every two intercalated groups cross each other or that at least their tips are in touch, thus forming a net-like surface against the fallen hair. The groups of three spikes 7 are preferably arranged on the external ribs 2 in such a way as to present a frontal net-like surface against the fallen hair carried away with the water flow during the taking of showers or washings or the like. This embodiment in particular allows the provision of large enough openings of the net-like structure 3 due to the above mentioned arrangement of spikes, and if desired the rows of radially disposed groups of spikes 7 could be increased as well as the height of the spikes 7, proportionally to the enlargement of the openings.

FIG. 25 illustrates the external ribs 2 of the net-like structure 3 ending in bristles 42 (or spikes, not shown) grouped as small inverted cone-shaped bunches and the internal ribs 2'.

FIG. 26 illustrates rows of contiguous bristles 43 (or spikes, not shown) over the external ribs 2 and the internal ribs 2'.

FIG. 28 illustrates external ribs 2 ending in bristles 44 (or spikes, not shown) grouped in a fan-like shape. The groups of bristles 44 (or spikes) keep the same spacing and disposition over the entire outer face of the net-like structure as over the imperforate strips 4 of the circular shapes 1, 1*a* and 1*b*. Each fan-shaped group opposes each other diagonally and alternately according to the following disposition: every two parallel external ribs 2, groups of bristles 44 (or spikes) in a fan-like shape are spaced at a minimal distance from each other group, preferably at the intersections of the external and internal ribs 2 and 2' of the net-like structure 3, and every two intercalated parallel external ribs 2, groups of bristles 44 (or spikes) in a fan-like shape are spaced preferably at the middle of each one of the segments of the external ribs 2 that are so determined by two of the said intersections, being the outer bristles of the fan-like shaped groups of bristles 44 (or spikes) at an angle 22 to the external ribs 2, so that the outer bristles 44 (or spikes) of every two intercalated fan-like shaped groups cross each other or at least their tips are in touch, thus forming a net-like surface against the fallen hair. The fan-like shaped groups of bristles 44 (or spikes) are preferably arranged on the external ribs 2 in such a way as to present a frontal net-like surface against the fallen hair carried away with the water flow during the taking of showers or washings or the like. This embodiment in particular allows the provision of large enough openings of the net-like structure 3 due to the above mentioned arrangment of bristles 44, (or spikes) and if desired the rows of fan-like shaped groups of bristles 44 (or spikes) could be increased as well as the height of the bristles 44 (or spikes), proportionately to the enlargement of the openings.

Figure 22:
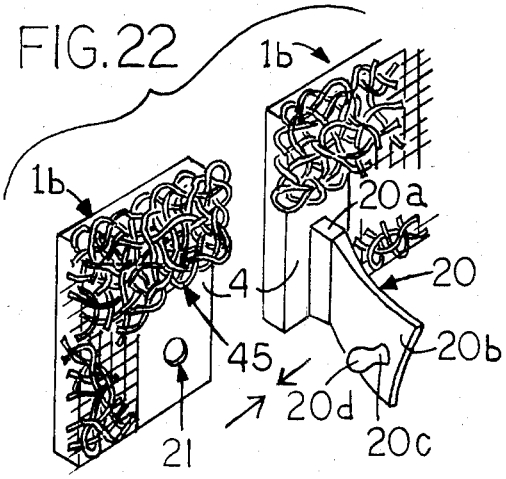
FIG. 22 is a simplified perspective view of an enlarge cross section of the preferred exemplary embodimenta illustrated in FIG. 10 taken along section lines 19–22 of FIG. 10, showing the preferred exemplary embodiment of the open web of crinkled filaments.

Turning now to the preferred embodiment of the open web 45, FIG. 22 shows the preferred circular shape 1*b* illustrating the preferred exemplary embodiment of the resilient open lofty integrated web 45 of crinkled unmodified or modified abrasive or foamed large diameter filaments. The hooking portion 22 and round opening 21 are also shown. The open web 45 is adherently bonded on its flattened surface 38 (see FIG. 29) to the outer surface of the net-like structure with a plurality of openings 3 and to the outer surface of the imperforate strips 4, preferably up to the area where the fastening means are placed. For the preferred embodiment of the open web 45 illustrated in FIG. 22 and also in FIGS. 27 and 29, a suitable diameter of the filaments could be between about 5 to 65 mils, and preferably 10 to 35 mils. In this figure and also in FIGS. 27 and 29 the filaments are slightly exaggerated for clarity purposes.

FIGS. 27 and 29 show the preferred circular shapes 1 and 1*a* with gripper 6 integral with the solid rectangular portion 5 placed on the outer face of a transversal imperforate strip 4 illustrating the preferred exemplary embodiment of the resilient open lofty integrated web 45 of interengaged continuous irregularly coiled unmodified or modified abrasive or foamed large diameter filaments. The open web 45 is adherently bonded on its flattened surface 38 (see FIG. 29) to the outer surface of the net-like structure, and to the outer surface of the imperforate strips 4, preferably up to the area where the attachable and fastening means are placed.

To determine the height of spikes, bristles or open web in reference to the preferred circular shapes 1 and 1*a*, it should be taken into account the space defined between the flange and the top of the lifted trip lever pop-up stoppers, or the like, of the drain control systems of bathtubs and the like, as well as the dimensions that should be given to the body of the article. In reference to the height of the spikes 7, 40, and 41, bristles 42, 43, and 44, or web 45, in the preferred circular shapes 1 and 1*a*, it is desirable that they be in touch or very close to the top of the stoppers, to avoid a gap between the circular shapes 1 and 1*a* and the top of the stoppers.

Furthermore, the spikes 7, 40 and 41, or bristles 42, 43 and 44, should be spaced at a minimal distance so as to increase the effectiveness of the entangling action, while the openings of the net-like structure and the openings of the open web should have suitable dimensions to allow the free flow of running water without hair into the drainpipe opening.

There is given an example of a height of spikes 7, 40 and 41, bristles 42, 43, 44, or open web 45 which might be suitable for the preferred circular shapes. For the preferred circular shapes 1 and 1*a* said height could be preferably approximately ¼", and for the circular shapes 1*b*, 1*b*', 1*c* and 1*d* said height could be preferably between about ¼" to ½".

Figure 30:
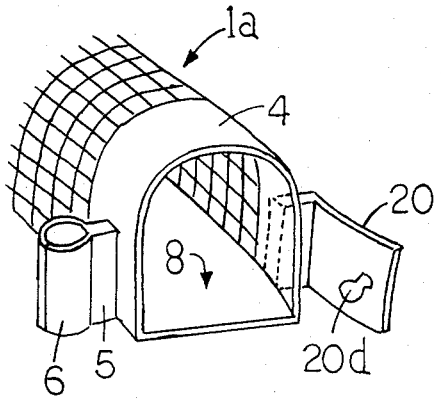
FIG. 30 is a perspective view in large scale partially in phantom of a fragmentary cross section of the preferred exemplary embodiment illustrated in FIG. 5 showing another preferred embodiment for the placement of attachable and fastening means in one of the transversal end imperforte strips.
Figure 31:
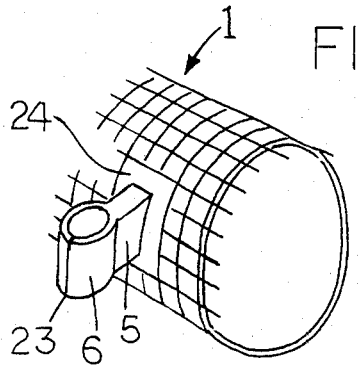
FIG. 31 is a simplified perspective view in large scale of a fragmentary cross section of the preferred exemplary embodiment illustrated in FIG. 1, showing another preferred embodiment of a small imperforate strip.

While the foregoing description of the imperforated strips 4 referred to a preferred embodiment of five transversal imperforate strips 4, the concept of the invention is equally effective, in another preferred exemplary embodiment illustrated in FIG. 30, where the number of imperforate strips 4 is reduced to four, where three of said four imperforate strips 4 bear attachable means placed concentrically oriented over the inner circumference of the body of the preferred circular shapes 1, 1*a* or 1*b* and the fourth imperforate strip is contiguous to one of said three imperforate strips 4 and said two contiguous imperforate strips 4 are placed at the open ends of said circular shapes 1, 1*a* and 1*b* bearing fastening means placed over the outer circumference of the body of said circular shapes 1, 1*a* and 1*b*, being one of the preferred transversal end imperforate strips 4 simultaneously the support of a gripper 6, placed over the inner circumference of the article, as well as the support of the hooking portion 15, 18 or 20 of the fastening means, placed over the outer circumference of the article. This figure shows the hooking portion 20. Additionally, another preferred embodiment of imperforate zones to be the support of the attachable means, the imperforate zone extend only around the area covered by the attachable means, thus projecting a minimum on the net-like structure, see strip 24 (FIG. 31), 25 (FIG. 32) and 26 (FIG. 33). In this embodiment of imperforate zones projecting a minimum on the net-like structure, the two transversal end imperforate strips 4, already described for the other preferred embodiments are also in this embodiment the support of the fastening means and they are located approximately half way between two of the other three aforementioned imperforate strips 24, 25 or 26, that extend only around the area covered by the attachable means. The imperforate strips 24 or 25 (FIGS. 31 and 32) have for example a rectangular configuration oriented transversally or longitudinally to the body of the article, and the imperforate strips 26 (FIG. 33) has for example a square configuration.

Figure 32:
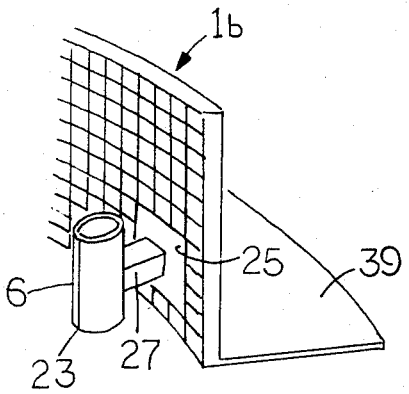
FIG. 32 is a perspective view in large scale of a fragmentary cross section of the preferred exemplary embodiment illustrated in FIG. 10 showing another preferred embodiment of the attachable means, and an optional flat imperforate base.
Figure 33:
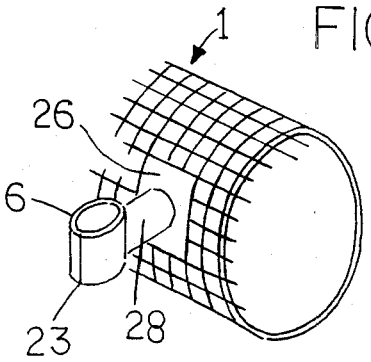
FIG. 33 is a simplified perspective view in large scale of a fragmentary cross section of the preferred exemplary embodiment illustrated in FIG. 1 showing another preferred embodiment of the attachable means.

Furthermore, FIG. 32 shows another preferred embodiment of the gripper 6, where the solid rectangular portion 27 is placed transversally to the hollow cylindrical gripper 6. And yet FIG. 33 illustrates another preferred embodiment where the gripper 6 is integral with a solid cylindrical portion 28 placed transversally to the hollow cylindrical gripper 6.

Figure 34:
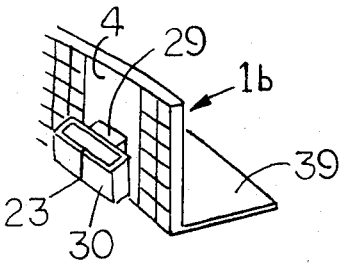
FIG. 34 is a perspective view in large scale of a fragmentary cross section of the preferred exemplary embodiment illustrated in FIG. 10 showing another preferred embodiment of attachable means, and an optional flat imperforate base.

While the aforegoing description dealt with attachable means suitable to be used with the trip-lever pop-up stoppers with rods or the like of the drain control systems of bathtubs and the like, there is shown in FIG. 34 another preferred exemplary embodiment of attachable means to be applied to the circular shape 1*b* and suitable to be used with the turnstop stopper of the drain control systems of bathtubs and the like, or with any other similar stopper, which is provided with two opposite holder slots. Said attachable means comprise two grippers 30 configured to define a hollow narrow rectangular shape having a vertical slit 23 at the center of its external longer side, said grippers 30 being integral with a solid narrow rectangular portion 29, and the hollow narrow rectangular gripper 30 is placed longitudinally oriented in reference to the body of the article, and the solid narrow rectangular portion 29 is placed longitudinally to the hollow narrow rectangular gripper 30, and the gripper 30 and solid narrow rectangular portion 29 are flexible but have the necessary stiffness to tightly grip the holder slots when the article is installed around and attached to said stopper. The preferred embodiment of the gripper 30 to be used with the turnstop stopper, is preferably applied to the circular shape 1*b*, since the circular shapes 1 and 1*a* are not as suitable to be used with said stopper. The location of the gripper 30 over the imperforate strips 4 for the circular shape 1*b* is the same as it has been described for the gripper 6. The previously described imperforate strips 4 are also applicable to the embodiment of the gripper 30. Since this embodiment of the gripper 30 is suitable to be used with the turnstop stopper which is provided with two holder slots or with any other similar stopper, it only required two imperforate strips 4 to bear the two grippers 30. In a preferred embodiment the imperforate strips 4 bearing the grippers 30 and the transversal end imperforate strips 4 bearing fastening means total three imperforate strips 4, being one of the transversal end imperforate strips 4 the support of a gripper 30 placed over the inner circumference of the article, and also of the hooking portion 15, 18 or 20 of the fastening means placed over the outer circumference of the article. If desired, four imperforate strips 4 could be used for the attachable and fastening means, although this may be less practical since there is a small space between the holder slots and between the flange and the top of said stopper. The previously described fastening means are equally applicable to this embodiment although having smaller dimensions to adapt to the aforementioned turnstop stopper. All the dimensions of the grippers 30 as well as their height and peripheral dimensions should be adapted to the height and dimensions of the holder slots of said stopper or to other similar fixtures, and the dimensions of the preferred circular shape 1*b* should also be adapted to the height of the lifted turnstop stopper or to any similar stopper.

Figure 35:
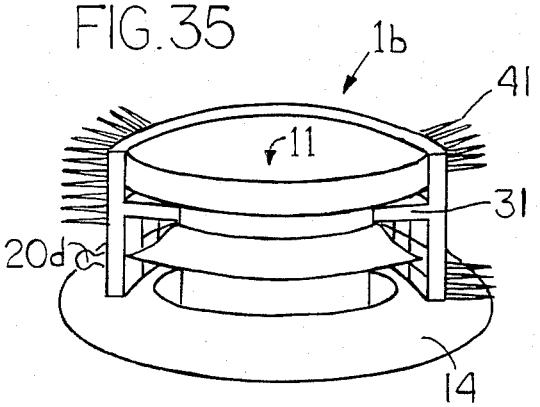
FIG. 35 is a perspective view of a transverse cross section, similar to FIG. 11, of a preferred exemplary embodiment of the article, similar to the embodiment illustrated in FIG. 10, installed around the tip toe stopper, showing a preferred embodiment of securement means. This figure is scaled to about the actual size used in bathtubs.
Figure 36:
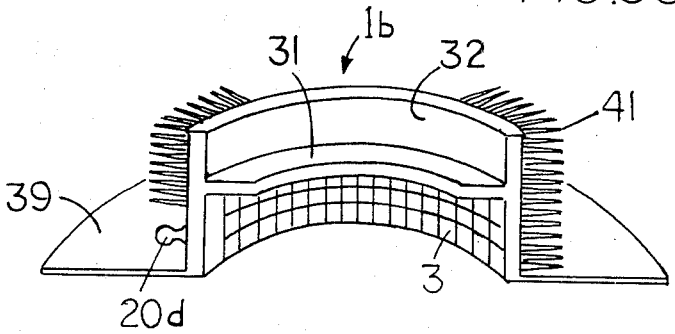
FIG. 36 is a view similar to FIG. 35 showing the placement of the securement means over the inner perimeter of the preferred embodiments shown in FIG. 35 and an optional flat imperforate base.
Figure 37:
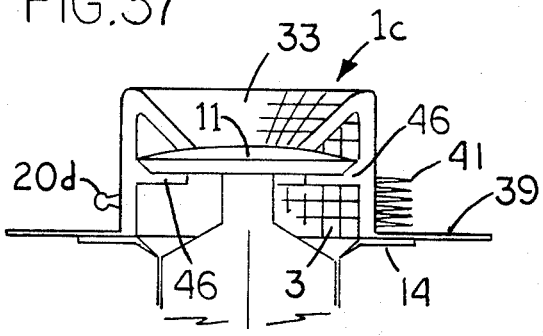
FIG. 37 is a schematic cross section view of another preferred embodiment of the article as installed around a pop-up stopper showing an optional flat imperforate base. This figure is scaled about the actual size used in lavatories.
Figure 38:
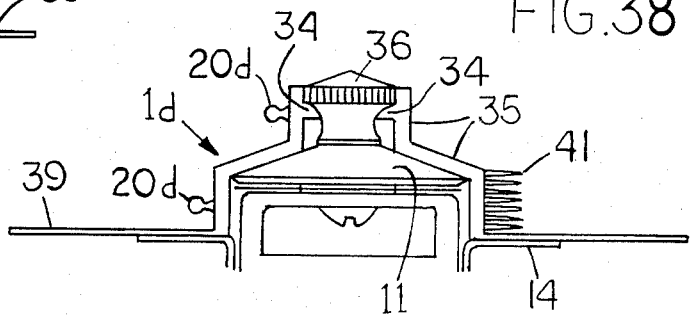
FIG. 38 is a schematic cross section view of another preferred embodiment of the article showing an optional flat imperforate base. The preferred embodiment illustrated in this figure applies to all the preferred embodiments of spikes, bristles, open web of crinkled filaments, or rough indented openings. This figure is scaled about the size used in bathtubs.

In addition, there is shown in FIGS. 35 and 36 another preferred embodiment of the article, the circular shape 1*b*′ which is similar to the circular shape 1*b* except for the fact of being provided with different embodiment of attachable means. The circular shape 1*b*′ has securement means comprising the provision of a rib 31. And FIGS. 37 and 38 illustrate other preferred embodiments of the article, the preferred circular shapes 1*c* and 1*d*, which also comprise the provision of a rib 46 and 34 respectively. These embodiments are suitable to be used with the tip toe stopper, the pop-up stopper, the turnstop stopper, or any other similar stopper.

FIG. 35 illustrates the circular shape 1*b*′ as installed around the tip toe stopper 11 resting over the flange 14 showing the internal rib 31 which is preferably configured to define the countour of the underside of the top of the tip toe stopper 11, thus having a narrow solid rectangular shape. The rib 31 is affixed to the underside of the top of the tip toe stopper 11. This figure also illustrates the round portion 20*d* of the fastening means. The upper portion of the circular shape 1*b*′ is preferably flush with the top of the tip toe stopper 11.

Referring now to FIG. 36, the circular shape 1*b*′ comprises an imperforate upper portion 32 that surrounds the edge of the tip toe stopper of bathtubs and the like, or the pop-up stoppers of lavatories and the like, which is integral with a lower portion constituted by a net-like structure with a plurality of openings 3, that covers the space defined between the flange and the top of said stoppers, and surrounds the drainpipe opening. Optionally, in another preferred embodiment of the circular shape 1*b*′, the lower portion constituted by a net-like structure 3 is integral with an outwardly directed surrounding open ended flat thin quite flexible circular imperforate base 39, as shown in FIG. 36, having a circular central hole defined therein of a size generally corresponding to that of the drainpipe opening. The base 39 covers, in a preferred embodiment, only the flange 14, and in another preferred embodiment it covers the flange and also extends a suitable distance over the surrounding area adjacent to the outer perimeter of the flange, providing one adhesive undersurface or an optional plain self sealing undersurface (not shown).

The imperforate upper portion 32 bears on its inner surface one rib 31 placed near the upper edge of the circular shape 1*b*′, extending longitudinally all along its inner circumference. The rib 31 is preferably configured to define the contour of the underside of the top of the tip toe stopper 11, thus having a narrow solid rectangular shape as mentioned above. The rib 31 is to be affixed to the underside of the top of the lifted tip toe stopper 11 (FIG. 35) when the circular shape 1*b*′ is installed around said lifted stopper or the like. The rib 31 is flexible but has the necessary stiffness to keep the circular shape 1*b*′ firmly affixed to the underside of the top of said lifted stopper, acting as a stop to prevent the circular shape 1*b*′ from lifting or moving during the passage of running water. The place for the location of the rib 31 is determined by the space defined by the underside of the top of said stoppers. The rib 31 should have a suitable depth so as to touch the central vertical cylinder of the tip toe stopper 11 (see FIG. 35), or should extend a suitable distance along the underside of the top of the pop-up stopper 11 or the like, as illustrated in FIG. 37 with the circular shape 1*c*, and its thickness should be determined by the space beneath the underside of the top of said stoppers, as well as by the effectiveness that the thickness of the rib 31 would have in acting as a stop on the underside of the top of said stoppers. The previously described preferred embodiments of fastening means, as well as the two transversal end imperforate strips 4, which are the support of the fastening means and the place for the location of said fastening means as described for the circular shape 1*b*, are equally applicable to the circular shape 1*b'*, 1*c* and 1*d* (FIGS. 35, 37 and 38). FIG. 36 shows the round portion 20*d* of the fastening means, and one transversal end imperforate strip 4. Preferably the outer face of both the upper and lower portion of the circular shape 1*b'* is provided with spikes 7, 40 and 41, bristles 42, 43, 44, or web 45, although, if desired, only the lower portion may be provided with spikes 7, 40, 41, bristles 42, 43, 44, or web 45, and the height of the circular shape 1*b'* is preferably such as to adapt to the space defined between the flange 14 and the top of the lifted tip toe stopper or pop-up stopper or the like, the upper edge of the circular shape 1*b'* is preferably flush with the top of the tip toe stopper or pop-up stopper or the like (see FIG. 35). And the circumferential dimension of the circular shape 1*b'* is such as to adapt to the circumferential dimension of the top of said lifted stoppers, so that the upper edge of the circular shape 1*b'* fits tightly along the perimeter of the top of said lifted stoppers, when placed around said stoppers, resting entirely over the flange 14.

FIG. 37 shows another preferred embodiment of the article, a circular vertical strip-like shape 1*c* which is similar to the preferred circular shape 1*b'* except for having an extended and bent upper portion 33. The upper portion is bent inward and downward towards the top of the pop-up stopper or the tip toe stopper or the like of bathtubs, lavatories and the like, at an angle of preferably approximately 45° touching with the folded upper edge the top of said lifted stoppers. The extended bent segment 33 is constituted by a net-like structure with a plurality of openings 3, the outer face of which is provided with spikes 7, 40, 41, or bristles 42, 43, 44, or open web 45. The circular shape 1*c* is also provided with a rib 46 placed over the inner surface of the imperforate zone 32, as in the circular shape 1*b'*, which surrounds the edge of the top of the stopper 11. The rib 46 is also preferably configured to define the contour of the underside of the top of the above-mentioned stoppers and extending a suitable distance on the underside of the top of said stoppers as stated earlier for the circular shape 1*b'*. Optionally, in another preferred embodiment of, the circular shape 1*c*, the lower portion constituted by a net-like structure 3 is integral with the previously described base 28, as shown in FIG. 37.

Referring now to FIG. 38, there is shown another most preferred exemplary embodiment of the article, an attachable open ended circular stepped strip-like shape 1*d*, as installed around the turnstop stopper 11 with the rib 34 affixed to the underside of the knob 36. Two round portions 20*d* of the fastening means are also known, one near the upper edge of the circular shape 1*d* and another near the flange 14. The circular shape 1*d* comprises a circular stepped upper portion 35 which is preferably imperforate and which is configured to define the contour of the top and of the knob 36 of the turnstop stopper 11 integral with a circular strip-like vertical lower portion that covers the space defined between the flange 14 and the top of said lifted stopper 11, and surrounds the drainpipe opening, and is constituted by a net-like structure with a plurality of openings 3, the outer face of which is provided with spikes 7, 40, 41, or bristles 42, 43 44, or open web 45. If desired, the outer face of the imperforate stepped upper portion 35 may also be provided with said spikes 7, 40, 41, or bristles 42, 43, 44, or open web 45. Optionally, in another preferred embodiment of the circular shape 1*d*, the circular strip-like vertical lower portion constituted by a net-like structure 3 is integral with the previously described outwardly directed surrounding open ended flat thin quite flexible circular imperforate base 39, shown in FIG. 38, having a circular central hole defined therein of a size generally corresponding to that of the drainpipe opening. The base provides an adhesive undersurface or a plain undersurface (not shown) that covers, in a preferred embodiment, only the flange 14 and in another preferred embodiment it covers the flange and the surrounding area adjacent to the outer perimeter of the flange. The imperforate circular stepped under portion 35 has a circular vertical upper segment which surrounds the knob 36 of the stopper 11, and the circular vertical upper segment bears on its inner surface one rib 34 placed near its upper edge, extending longitudinally all along its inner circumference (see FIG. 39). The rib 34 is to be affixed to the underside of the knob 36 of the lifted turnstop stopper 11, as shown in FIG. 38, when said circular shape 1*d* is installed around said lifted stopper or the like. The rib 34 is preferably configured to define the inward curve of the underside of the knob 36, and is flexible but has the necessary stiffness to keep the circular shape 1*d* firmly affixed to the underside of the knob 36, acting as a stop to prevent the circular shape 1*d* from lifting or moving during the passage of running water. The place for the location of the rib 34 is determined by the space defined by the inward curved underside of the knob 36. Said rib 34 should have a suitable depth so as to fit tightly around the underside of the knob 36 and its thickness should be determined by the space beneath the underside of the knob 36 as well as by the effectiveness that the thickness of the rib 34 should have in acting as a stop on the underside of the knob 36 of said lifted stopper 11.

Figure 39:
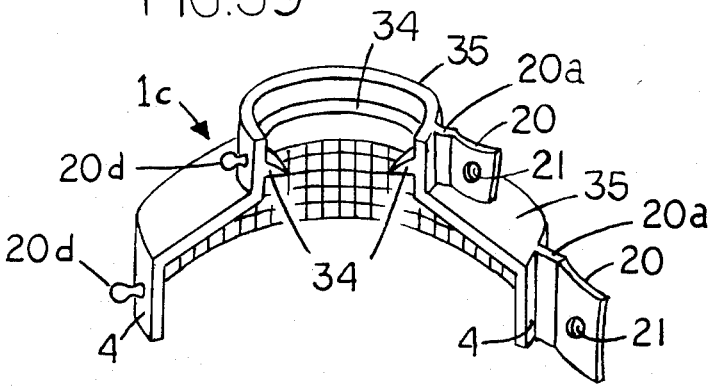
FIG. 39 is a perspective view of the embodiment illustrated in FIG. 38 in a stretched out open position, showing the placement of the securement means and fastening means.

The previously described preferred embodiments of fastening means, as well as the two transversal end imperforate strips 4 which are the support of the fastening means are equally applicable to the circular shape 1*d* as illustrated in FIG. 38 and also in FIG. 39. The circular shape 1*d* is provided with fastening means at the open ends of the circular vertical lower portion, placed on the outer face of the transversal end imperforate strips 4, and over its outer circumference, the hooking portion being placed on one of said strips 4 and the receiving portion being placed on the opposite strip 4, and said fastening means being located at the level of the lower edge of the circular vertical lower portion of the circular shape 1*d* and extending over the outer face of the strips 4, preferably up to the top of the stopper 11, where the stepped imperforate upper portion begins. In addition, there is provided fastening means at the open ends of the imperforate circular vertical upper segment of the upper portion 35, which surrounds the knob 36. The fastening means are placed at the open ends on the outer surface of said imperforate vertical upper segment, over its outer circumference. The hooking portion of the fastening means is placed on one end of the circular vertical upper segment, and the receiving portion is placed on the opposite end of the circular vertical upper segment, and the fastening means extend along the open ends of the vertical upper segment preferably the same height as said vertical upper segment.

As illustrated in FIGS. 35 to 39, the parts constituting the fastening means are preferably placed on the circular shapes 1*b'*, 1*c* and 1*d* in an arrangement which is reverse to the one which has been previously described in other embodiments and illustrated in FIGS. 13 to 22, FIGS. 35 and 39 show said reversed arrangement as applied to the round portion 20*d* and round opening 21.

The height of the circular shape 1*d* is determined by the space defined between the flange 14 and the top of the knob 36 of the lifted turnstop stopper 11, and its circumferential dimension is such as to adapt to the circumferential dimension of the lifted stopper 11, so that the circumference of the upper edge of the circular vertical upper segment of the imperforate circular upper portion 35 of said circular shape 1*d*, fits tightly along the perimeter of the knob 36, and the circumference of the circular vertical lower portion fits tightly along the perimeter of the top of the lifted stopper 11, when the circular shape 1*d* is placed around the stopper 11, resting over the flange 14, with the base 39 extending in a preferred embodiment over the surrounding area (see FIG. 38)

Furthermore, in another preferred embodiment of the preferred circular shapes 1 and 1*a*, said circular shapes are open ended and provided only with fastening means, i.e. without grippers. This embodiment is particularly suitable to be used with any standard pop-up stoppers, provided with fins or rods or with the tip toe stopper provided with a cylindrical body (or the like) of bathtubs and the like, although if desired it could also be used in lavatories.

This preferred embodiment of the circular shapes 1 and 1*a* without attachable means, is similar in any other respect, including the preferred embodiments of the fastening means, to the previously described circular shapes 1 and 1*a*, which are provided with attachable means, and all the preferred exemplary embodiments of spikes 7, 40 and 41, bristles 42, 43, 44, and open web 45 are also applicable to the circular shapes 1 and 1*a* without attachable means.

This embodiment is not shown in the drawings as it has been deemed unnecessary because the circular shapes 1 and 1*a* in this embodiment, are equal in every respect to the ones illustrated in the drawings except for the lack of said attachable means, and also have basically the same dimensions that have been previously given, although a slight increase in the height of the spikes 7, 40, 41, or bristles 42, 43, 44, or open web 45 could be more efficient in keeping the article firmly in place through tight contact with the aforementioned fins, rods or cylindrical body of said standard stoppers.

Furthermore, the net-like structure with a plurality of openings 3 that constitutes the body of the circular shapes 1, 1*a*, 1*b*, 1*b'*, 1*c* and 1*d* of the article may have in another preferred exemplary embodiment (not shown) rough indented openings, and the rough indented edges of said openings protrude a suitable length and extend preferably perpendicularly to the net-like structure 3, so that the outer face of the net-like structure 3 is provided with a surface similar to the surface of a grater, exerting a gripping action upon the fallen hair. If desired, the imperforate zones of said circular shapes could also be provided with rough indented openings, except around the areas where the attachable and fastening means are placed. The circular shapes 1 and 1*a* provided with rough indented openings are preferably dimensioned in such a way as to adapt to the space defined between the flange and the top of the lifted trip lever pop-up stopper or the like of bathtubs, and the like, and to cover with their body the entire entrance to the drainpipe opening, and the inner circumference of the circular shapes 1 and 1*a* preferably surround closely the rods or the like of said stoppers, in which case the width of the solid rectangular portion 5 of the gripper 6 is accordingly suitably reduced. On the other hand, the dimensions of the circular shapes 1*b*, 1*b'*, 1*c* and 1*d* provided with rough indented openings, correspond to the description previously given for these circular shapes 1*b*, 1*b'*, 1*c* and 1*d*.

In addition, the preferred circular shape 1*b'*, provided with a rib 31 suitable to be used with the tip toe stopper or the like of bathtubs and the like, or with the pop-up stopper or the like of lavatories and the like, could also be made, if desired, of a more permanent material such as, for example, brass, stainless steel, bronze, copper or the like, by casting process, or by any other equally suitable process, in which case the circular shape 1*b'* will have no fastening means at its open ends, and will be provided with hinges located opposite to said open ends to allow the opening of said rigid circular shape 1*b'* in order to be installed around said stoppers and to be affixed with said rib 31 to the top of said stopper. In this embodiment, said circular shape 1*b'* is provided with flexible spikes, or bristles of brass, stainless steel, bronze, copper or the like, or with a bonded flexible, open lofty web of continuous irregularly coiled filaments of brass, stainless steel, bronze, copper or the like, being the diameter of the filaments between about 5 to 65 mils and preferably 10 to 35 mils. The metal web could be produced by extrusion and "knitting" processes, well known to those skilled in the art. Optionally, in this embodiment, using a more permanent material, the outer face of the net-like structure with a plurality of openings 3 of the circular shape 1*b'* provided with a rib 31, may have the aforementioned rough indented openings (not shown). In this embodiment, the circular shape 1*b'* is not provided with the base 39 and comprises the previously described imperforate and perforate zones, and is also dimensioned to fit tightly around said stoppers.

From the foregoing detailed description of the article it will be apparent that numerous modifications can be made without affecting the concept of the invention, for example, any other feature which could exert an entangling or gripping action upon the fallen hair, besides the ones described herein, may also be employed, and any other suitable type of attachable means or securing means besides the ones described herein that fulfills the same function may also be employed. Also, the number of attachable means may vary according with variations in the number of rods and similar fixtures on different stoppers.

Besides, the cross section forms of the article could also be modified or any other cross section form which has the same advantages may also be employed.

No specific data were given herein in regard to the kind of adhesives, bonding resins and other substances that may be used in practicing the invention, and also in regard to specific grades of materials which are best suited for the article of the present invention. It should be noted, however, that these characteristics, materials and other details are well known to those skilled in the art, and no protection is sought for these expedients beyond the features explained hereinbefore and set forth in the claims.

The article of the present invention, in its most preferred exemplary attachable open ended circular shapes 1, 1*a*, 1*b*, 1*b'*, 1*c* and 1*d*, in order to prevent hair, hairpins, or any other object carried away with the water flow during the taking of showers or washings or the like, from entering and clogging the drainpipes of bathtubs, lavatories and the like, is to be installed around and attached to the rods or the like of the lifted conventional pop-up stoppers, the tip toe stopper, the turnstop stopper or the like, of the drain control systems of bathtubs, lavatories and the like, with the attachable means, and its open ends closed with the fastening means, or the article is to be just fastened around said pop-up stoppers or the like.

The objective of preventing hair, hairpins, or any other object, from entering and clogging the drainpipes, is then carried out through the entangling and gripping action, exerted upon the fallen hair, hairpins or any other object carried away with the water flow, by the flexible spikes 7, 40, 41, or bristles 42, 43, 44, or by the resilient open lofty integrated web 45 of interengaged continuous crinkled filaments, or by rough indented openings, which prevent the fallen hair, hairpins or any other object from entering and clogging the drainpipes of bathtubs, lavatories and the like. Said entangling and gripping action is reinforced by a blocking action exerted upon the fallen hair, hairpins or any other object by the circular shape of the article in all its preferred embodiments, which prevents the fallen hair, hairpins or any other object from entering and clogging the drainpipe of bathtubs, lavatories and the like, by surrounding the entire circumference of its opening when the article is installed around and attached to said lifted stoppers of the drain control systems, while the large enough openings of the net-like structure 3 or of the open web 45 insure the free flow of running water, and the flat imperforate base 8 or 39 with several preferred undersurfaces, contributes to a secure installation of the article in some of its preferred circular shapes.

While the preferred exemplary embodiments of the invention have been illustrated and described, although not by way of limitation, it will be obvious to those skilled in the art that various changes and modifications can be made without departing from the spirit and scope of the invention and without sacrificing any of its advantages, and it is intended to cover in the appended claims all such changes and modifications that are within the scope of this invention.

What I claim is:

1. An article for preventing hair and debris from entering a drain of a bathtub, shower stall, lavatory, sink and the like having a liftable stopper and a flange, said article comprising:

a body shaped and dimensioned to be adapted to extend entirely around the lifted stopper periphery and to extend entirely around the external periphery of the drain generally covering the area between the drain periphery and the top of the lifted stopper periphery;

said body being of filamentary material defining openings for the free passage of water therethrough down into the drain;

a plurality of outward projections connected to said filamentary material above said openings and cooperating therewith, operable to entangle and hold hair and debris carried by water flowing through said openings; and attaching means connected to and projecting radially inwardly from said body for engaging a lifted stopper below the top thereof to attach said body thereto.

2. An article as defined in claim 1, for use with a stopper having portions extending downwardly from the top thereof, wherein said attaching means comprises a plurality of grippers connected to and projecting inwardly from said body at spaced locations along the inner circumference of said body, each of said grippers having a hollow segment with a slit dividing it into opposed flexible and resilient jaws for gripping engagement with a portion of the stopper below the top of the stopper.

3. An article as defined in claim 2, wherein said hollow segments of the grippers are substantially cylindrical.

4. An article as defined in claim 2 wherein said hollow segments of the grippers are substantially rectangular in cross-section.

5. An article as defined in claim 1, wherein said attaching means comprises a rib connected to the inner circumference of said body and extending laterally inwardly therefrom for engaging the stopper below the top of the stopper.

6. An article as defined in claim 5 wherein said rib has a top face lying substantially in a plane perpendicular to the geometric axis of said body.

7. An article as defined in claim 5, wherein said rib has a top face which is inclined downwardly and inwardly.

8. An article as defined in claim 1 wherein said body has a separation at one point along its circumference, and further including manually attachable and releasable fastener means provided on said body on opposite sides of said separation, respectively, for holding said body together to form a continuous annulus.

9. An article as defined in claim 8, for use with a stopper having portions extending downwardly from the top thereof, wherein said attaching means comprises a plurality of grippers connected to and projecting inwardly from said body at spaced locations along the inner circumference of said body, each of said grippers having a hollow segment with a slit dividing it into opposed flexible and resilient jaws for gripping engagement with a portion of the stopper below the top of the stopper.

10. An article as defined in claim 9 wherein said hollow segments of the grippers are substantially cylindrical.

11. An article as defined in claim 9 wherein said hollow segments of the grippers are substantially rectangular in cross-section.

12. An article as defined in claim 8 wherein said attaching means comprises an annular rib connected to the inner circumference of said body and extending laterally inwardly therefrom for engaging the stopper below the top of the stopper.

13. An article as defined in claim 12 wherein said rib has a top face lying substantially in a plane perpendicular to the geometric axis of said body.

14. An article as defined in claim 12 wherein said rib has a top face which is inclined downwardly and inwardly.

15. An article as defined in claim 8 wherein said fastener means comprises a hook element pivoted on said body on one side of said separation and means formed on the opposite side of said separation defining an opening for receiving said hook element.

16. An article as defined in claim 8 wherein said fastener means comprises a hook element pivoted on said body on one side of said separation and an engaging element on the opposite side of said separation defining an opening for receiving said hook element.

17. An article for preventing hair and debris from entering a drain of a bathtub, shower stall, lavatory, sink and the like having a liftable stopper and a flange, said article comprising:

a body shaped and dimensioned to be adapted to extend entirely around the lifted stopper periphery and to extend entirely around the external periphery of the drain generally covering the area between the drain periphery and the top of the lifted stopper periphery;

said body being of filamentary material defining openings for the free passage of water therethrough down into the drain;

a plurality of outward projections connected to said filamentary material above said openings and cooperating therewith, operable to entangle and hold hair and debris carried by water flowing through said openings;

said body having a separation at one point along its circumference, and manually attachable and releasable fastener means provided on opposite sides of said separation, respectively, for holding said body together to form a continuous annulus.

* * * * *